US010720113B2

(12) United States Patent
An et al.

(10) Patent No.: US 10,720,113 B2
(45) **Date of Patent: *Jul. 21, 2020**

(54) IMAGE DISPLAY APPARATUS CAPABLE OF IMPROVING CONTRAST

(71) Applicant: LG ELECTRONICS INC., Seoul (KR)

(72) Inventors: Byunghyun An, Seoul (KR); Hyungoon Kim, Seoul (KR); Kanghyun Yoon, Seoul (KR); Gwangmi Go, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/441,818

(22) Filed: Jun. 14, 2019

(65) Prior Publication Data

US 2019/0295479 A1 Sep. 26, 2019

Related U.S. Application Data

(63) Continuation of application No. 15/463,791, filed on Mar. 20, 2017, now Pat. No. 10,366,662.

(30) Foreign Application Priority Data

Mar. 21, 2016 (KR) ..... 10-2016-0033572

(51) Int. Cl.
*G09G 3/34* (2006.01)

(52) U.S. Cl.
CPC ..... *G09G 3/3426* (2013.01); *G09G 2320/066* (2013.01); *G09G 2320/0626* (2013.01); *G09G 2320/0686* (2013.01); *G09G 2330/021* (2013.01)

(58) Field of Classification Search
CPC ..... G09G 3/3426; G09G 2330/021; G09G 2320/066; G09G 2320/0626
See application file for complete search history.

(56) References Cited

U.S. PATENT DOCUMENTS 10,062,334 B2 8/2018 You et al.
2009/0091265 A1* 4/2009 Song ..... G09G 3/3413 315/185 R
2010/0277514 A1 11/2010 Yeo et al.
(Continued)

FOREIGN PATENT DOCUMENTS

KR 10-2016-0029553 3/2016

OTHER PUBLICATIONS

Anonymous: "Pulse-Amplitude-Modulation Drive Control of LEDs" IP.com *Journal*, IP.com Inc. West Henrietta, NY, Jul. 2, 2002. XP 013003659.

(Continued)

*Primary Examiner* — Kwang-Su Yang
(74) *Attorney, Agent, or Firm* — KED & Associates, LLP

(57) ABSTRACT

An image display apparatus is disclosed. The image display apparatus includes a panel, a plurality of light sources to output light to the panel, a plurality of switching elements to switch the light sources, and a processor to control the switching elements, wherein the processor controls a current having a variable level to flow into each light source string among the light sources, based on local dimming data, thereby improving contrast in displaying images.

20 Claims, 15 Drawing Sheets

(56) References Cited

U.S. PATENT DOCUMENTS

| | | | | |
|---|---|---|---|---|
| 2011/0121755 | A1 | 5/2011 | Han | |
| 2013/0241976 | A1 | 9/2013 | Kang et al. | |
| 2013/0321484 | A1 | 12/2013 | Kim et al. | |
| 2014/0035484 | A1 | 2/2014 | Carli | |
| 2014/0118417 | A1* | 5/2014 | Kang | G09G 5/10 345/690 |
| 2015/0002049 | A1 | 1/2015 | Hu | |
| 2015/0062483 | A1 | 3/2015 | Zhang et al. | |
| 2015/0116379 | A1 | 4/2015 | Lim | |

OTHER PUBLICATIONS

European Search Report dated Jul. 17, 2019 issued in EP Application No. 17770578.7.

International Search Report dated Jul. 10, 2017 issued in Application No. PCT/KR2017/002997.

* cited by examiner

IMAGE DISPLAY APPARATUS CAPABLE OF IMPROVING CONTRAST

CROSS-REFERENCE TO RELATED APPLICATION

This application is a Continuation Application of U.S. application Ser. No. 15/463,791 filed on Mar. 20, 2017, which claims the priority benefit of Korean Patent Application No. 10-2016-0033572, filed on Mar. 21, 2016 in the Korean Intellectual Property Office, the disclosures of which are incorporated herein by reference.

BACKGROUND OF THE INVENTION

1. Field of the Invention

The present invention relates to an image display apparatus and, more particularly, to an image display apparatus capable of improving contrast in displaying images.

2. Description of the Related Art

Digital broadcasting refers to broadcasting that transmits digital images and audio signals. Compared to analog broadcasting, digital broadcasting is robust to external noise and thus suffers less data loss. In addition, digital broadcasting is advantageous for error correction and provides high definition and clear images. Further, digital broadcasting enables bidirectional services unlike analog broadcasting.

Meanwhile, according to demands of a user who desires to view a clear screen, resolution of an image display apparatus tends to increase and thus an image display apparatus having higher resolution has been developed.

SUMMARY OF THE INVENTION

It is an object of the present invention to provide an image display apparatus capable of improving contrast in displaying images.

It is another object of the present invention to provide an image display apparatus capable of reducing heat generated by a plurality of switching elements for switching a plurality of light sources.

In accordance with an aspect of the present invention, the above and other objects can be accomplished by the provision of an image display apparatus including a panel, a plurality of light sources to output light to the panel, a plurality of switching elements to switch the light sources, and a processor to control the switching elements, wherein the processor controls a current having a variable level to flow into each light source string among the light sources, based on local dimming data.

In accordance with another aspect of the present invention, there is provided an image display apparatus including a panel, a plurality of light sources to output light to the panel, a plurality of switching elements to switch the light sources, and a processor to control the switching elements, wherein, if a level of local dimming data is equal to or higher than a first reference level, the processor controls a current having a variable level to flow into each light source string among the light sources as a first mode, based on the local dimming data, and if the level of the local dimming data is lower than the first reference level, the processor controls a current having a constant level and a variable pulse width to flow into each light source string among the light sources as a second mode, based on the local dimming data.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

The suffixes "module" and "unit" in elements used in description below are given only in consideration of ease in preparation of the specification and do not have specific meanings or functions. Therefore, the suffixes "module" and "unit" may be used interchangeably.

Figure 1:
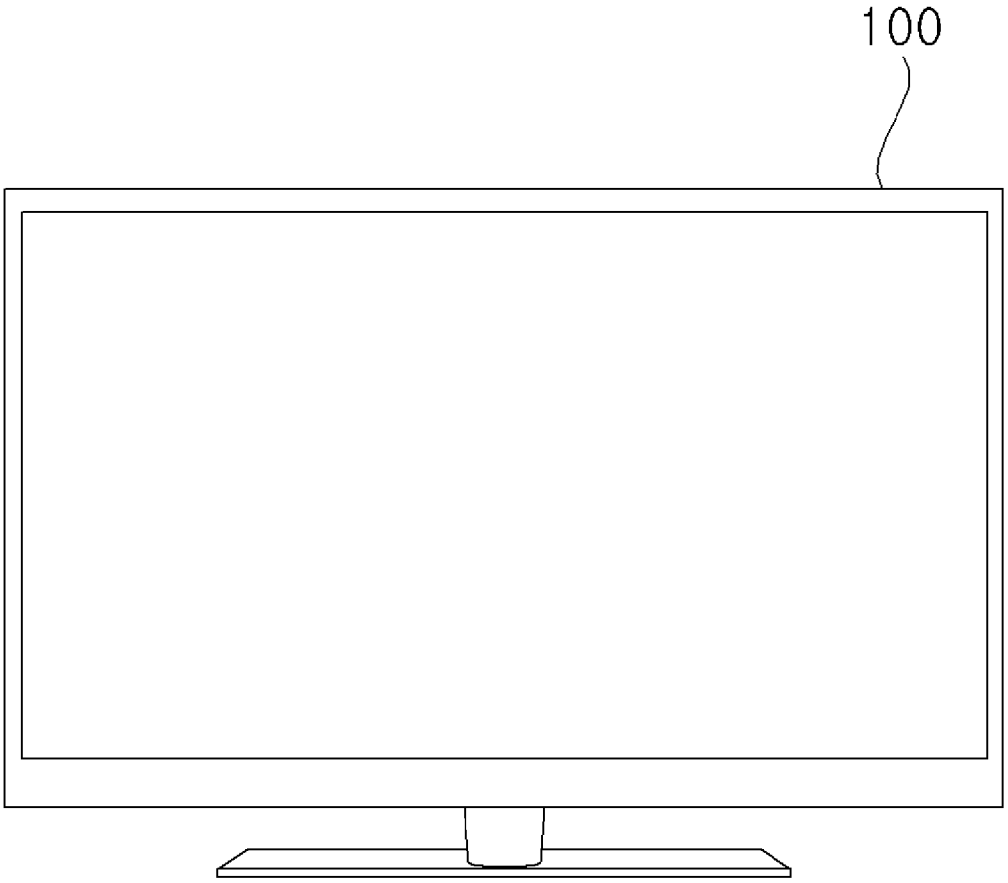
FIG. 1 is a view illustrating an outer appearance of an image display apparatus according to an embodiment of the present invention.

FIG. 1 illustrates an outer appearance of an image display apparatus according to an embodiment of the present invention.

Referring to FIG. 1, an image display appearance 100 according to an embodiment of the present invention may include a display (180 shown in FIG. 2), a controller (170 shown in FIG. 2) for performing a control operation to display images on the display, and a power supply (190 shown in FIG. 2) for supplying power to the display.

Meanwhile, as resolution of the image display apparatus 100 increases up to high definition (HD), full HD, ultra high definition (UHD), etc., various schemes for improving contrast in displaying images have been studied.

An embodiment of the present invention describes a scheme for improving contrast in displaying images by controlling level-varying current to flow into each light source string among a plurality of light sources.

Figure 7:
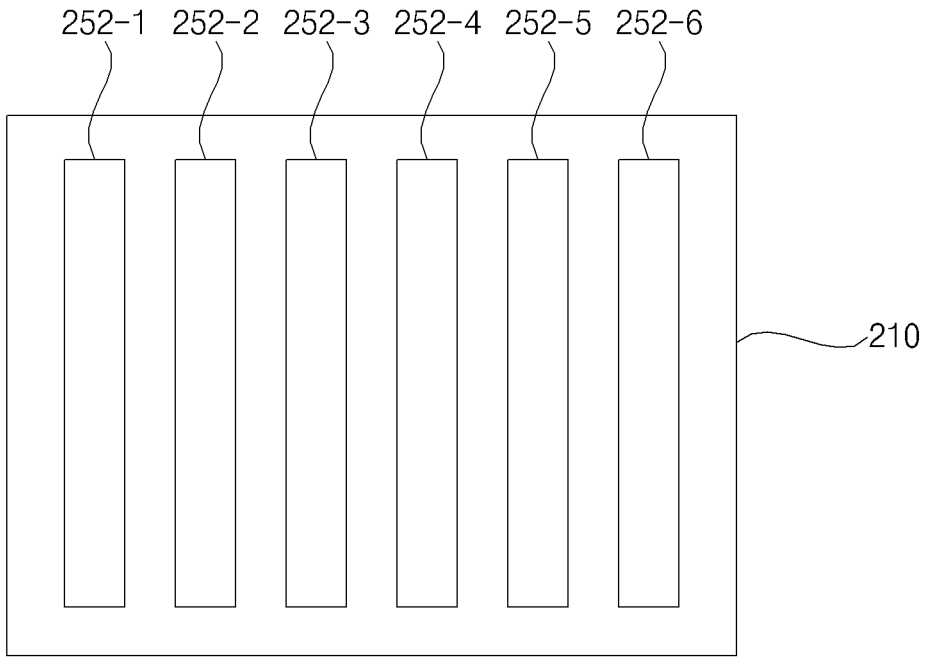
FIG. 7 is a diagram illustrating exemplary arrangement of light sources shown in FIG. 6.
Figure 8:
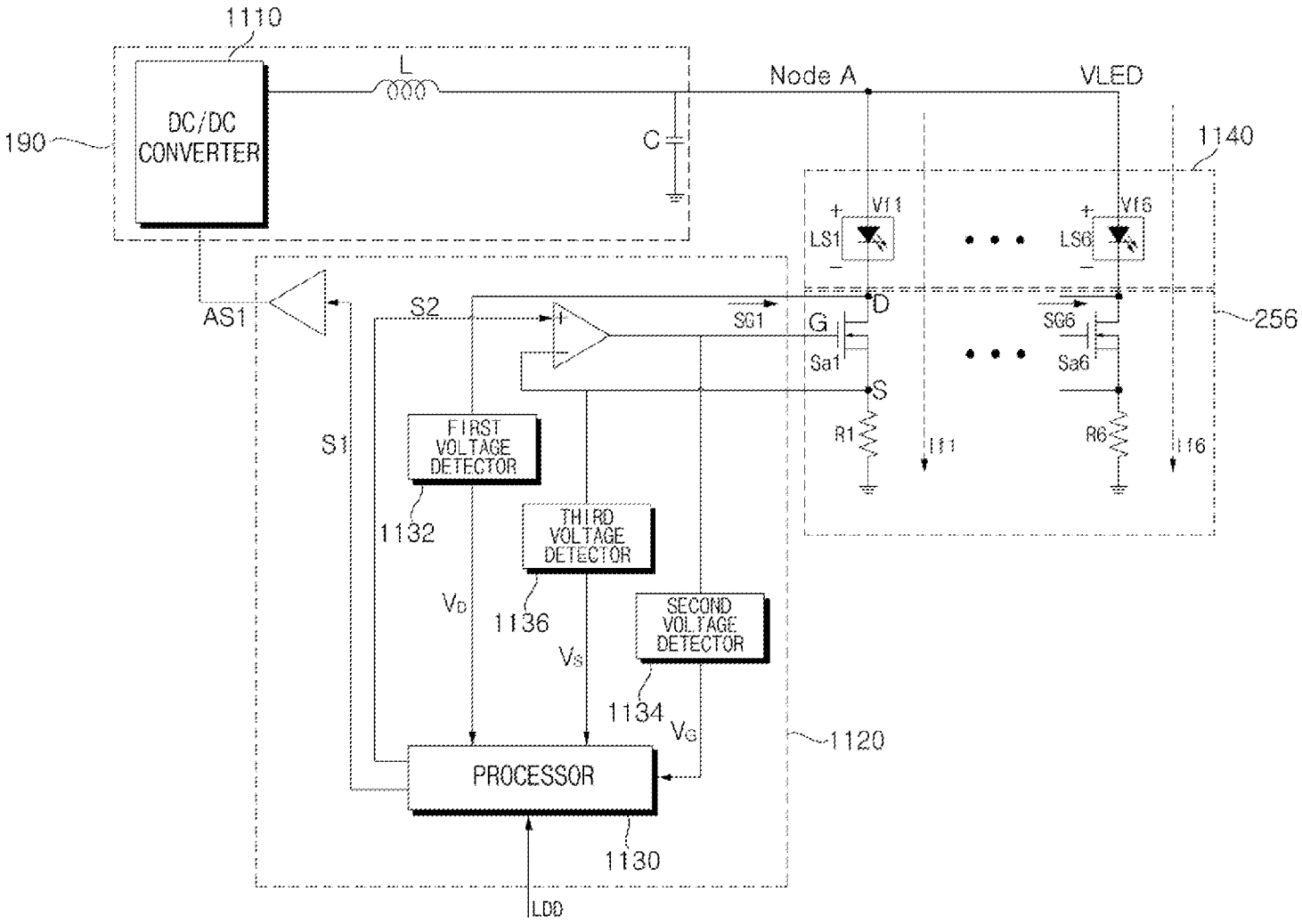
FIG. 8 is a partial circuit diagram of the image display apparatus according to an embodiment of the present invention.

Specifically, the image display apparatus 100 includes a panel (210 shown in FIG. 6), a plurality of light sources (252 shown in FIG. 6), for outputting light to the panel (210 shown in FIG. 6), a plurality of switching elements (Sa1 to Sa6 shown FIG. 8) for switching the light sources (252 shown in FIG. 6), and a processor (1130 shown in FIG. 8) for controlling the switching elements (Sa1 to Sa6 shown FIG. 8). The processor (1130 shown in FIG. 8) controls a level-varying current (If) to flow into each of light source strings (251-1 to 252-6 shown in FIG. 7) among the light sources (252 shown in FIG. 6), thereby improving contrast in displaying images.

In particular, if the level of local dimming data is equal to or higher than a first reference level, the processor (1130 shown in FIG. 8) controls a level-varying current to flow into each light source string among the light sources as a first mode, based on the local dimming data, thereby improving contrast in displaying images.

As the level of the local dimming data decreases, the level of the current flowing into each light source string in the first mode is set to be low, so that heat generated by the switching elements can be reduced. Therefore, a circuit element can be prevented from being damaged.

Meanwhile, resolution of the image display apparatus 100 is proportional to power consumption thereof. As such, various schemes for reducing power consumption have been studied.

An embodiment of the present invention also describes a scheme for reducing heat generated by a plurality of switching elements for switching a plurality of light sources.

Meanwhile, if the display 180 includes a liquid crystal panel, an additional light source, for example, a light emitting diode (LED), is used.

In this case, about 60 to 70% of power consumed in the image display apparatus 100 is consumed by light source or a circuit element for driving the light source. Particularly, if resolution of the image display apparatus 100 increases up to HD, full HD, UHD, 4K, 8K, etc., at least one of a driving voltage Vf for driving an LED as a light source or a driving current If flowing into the LED increases.

As the LED driving voltage Vf in the light source increases, a level of a common voltage applied commonly to a plurality of light sources increases. In this situation, as a current level flowing into switching elements for driving the light sources increases, power consumed by the switching elements increases and generation of heat increases.

Therefore, the present invention discloses a method of reducing generation of heat of a plurality of switching elements for switching a plurality of light sources in driving the light sources.

In more detail, if the level of local dimming data is lower than a first reference level, the image display apparatus 100 may perform control to allow a current having a constant level and a variable pulse width to flow into each light source string among the light sources as a second mode, based on the local dimming data, thereby reducing power consumption.

The image display apparatus 100 may set a potential difference between a drain terminal and a source terminal of each of the switching elements in the first mode to be smaller than that in the second mode, thereby reducing switching loss in the first mode.

On the other hand, the image display apparatus 100 may set a difference between the potential difference between the drain terminal and the source terminal of each of the switching elements in the second mode and that in the first mode to increase as the level of the local dimming data increases, thereby further reducing switching loss in the first mode.

A scheme of improving contrast in displaying images in the above-described image display apparatus will be described in more detail with reference to FIG. 8 and subsequent drawings.

Figure 2:
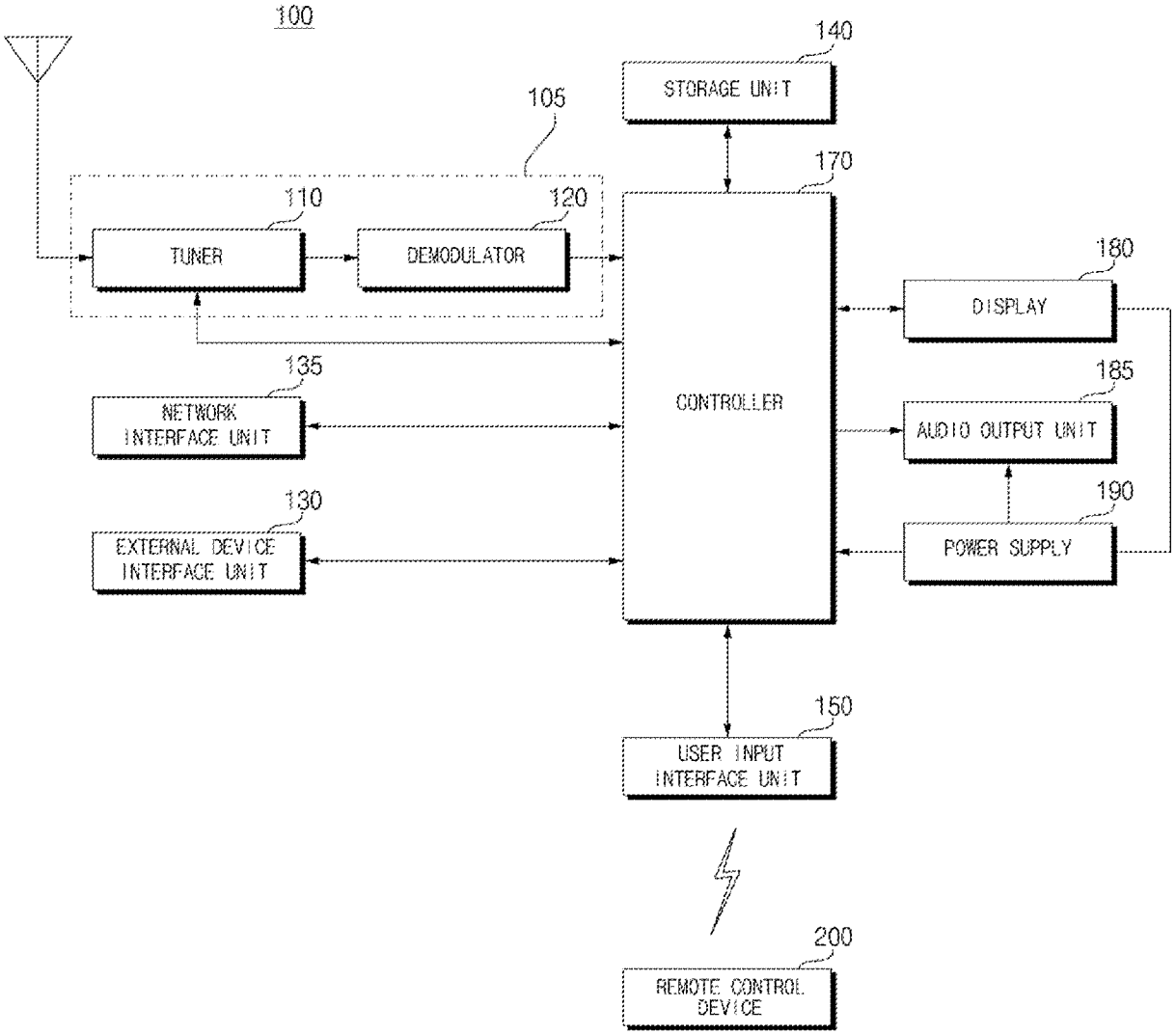
FIG. 2 is an internal block diagram of the image display apparatus according to an embodiment of the present invention.

FIG. 2 is an internal block diagram of the image display apparatus according to an embodiment of the present invention.

Referring to FIG. 2, the image display apparatus 100 according to an embodiment of the present invention may include a broadcast receiver 105, an external device interface unit 130, a storage unit 140, a user input interface unit 150, a sensor unit (not shown), a controller 170, a display 180, and an audio output unit 185.

The broadcast receiver 105 may include a tuner 110, a demodulator 120, and a network interface unit 135. As needed, the broadcast receiver 105 may be designed not to include the network interface unit 135 while including the tuner 110 and the demodulator 120. In contrast, the broadcast receiver 105 may include only the network interface unit 135 and does not include the tuner 110 and the demodulator 120.

Unlike FIG. 2, the broadcast receiver 105 may include the external device interface unit 130. For example, a broadcast signal generated by a set-top box (not shown) may be received through the external device interface unit 130.

The tuner 110 selects a radio frequency (RF) broadcast signal corresponding to a channel selected by a user or all prestored channels from among RF broadcast signals received through an antenna. In addition, the tuner 110 converts the selected RF broadcast signal into an intermediate frequency (IF) signal, a baseband image, or an audio signal.

For example, if the selected RF broadcast signal is a digital broadcast signal, the tuner 110 converts the digital broadcast signal into a digital intermediate frequency (DIF) signal. If the selected RF broadcast signal is an analog broadcast signal, the tuner 110 converts the analog broadcast signal into an analog baseband image or an audio signal (composite video baseband signal (CVBS)/sound IF (SIF)). That is, the tuner 110 may process a digital broadcast signal or an analog broadcast signal. The analog baseband image or audio signal (CVBS/SIF) output from the tuner 110 may be directly input to the controller 170.

The tuner 110 may sequentially select RF broadcast signals for all broadcast channels stored through a channel memorization function from among RF broadcast signals received through the antenna and convert the same into an IF signal, a baseband image, or an audio signal.

To receive broadcast signals of a plurality of channels, a plurality of tuners 110 may be provided. Alternatively, a single tuner to receive broadcast signals of a plurality of channels simultaneously may be provided.

The demodulator 120 receives and demodulates the DIF signal converted by the tuner 110.

After performing demodulation and channel decoding, the demodulator 120 may output a transport stream (TS) signal. Herein, the stream signal may be a signal obtained by multiplexing an image signal, an audio signal, and a data signal.

The TS signal output from the demodulator 120 may be input to the controller 170. After performing demultiplexing and image/audio signal processing, the controller 170 outputs an image to the display 180 and audio to the audio output unit 185.

The external device interface unit 130 may transmit or receive data to or from an external device connected thereto. To this end, the external device interface unit 130 may include an audio/video (AN) input/output unit (not shown) or a wireless communication unit (not shown).

The external device interface unit 130 may be connected to external devices such as a digital versatile disc (DVD), a Blu-ray player, a game console, a camera, a camcorder, a (notebook) computer, and a set-top box in a wired/wireless manner and perform input/output operations with external devices.

The A/V input/output unit may receive image and audio signals from an external device. The wireless communication unit may perform short-range wireless communication with other electronic devices.

The network interface unit 135 provides an interface for connecting the image display apparatus 100 with a wired/wireless network including the Internet. For example, the network interface unit 135 may receive content or data provided by an Internet or content provider or a network operator over a network.

The storage unit 140 may store programs for processing and control of signals in the controller 170 and also store a signal-processed image, audio, or data signal.

The storage unit 140 may function to temporarily store an image signal, an audio signal, or a data signal input through the external device interface unit 130. In addition, the storage unit 140 may store information about a predetermined broadcast channel through the channel memorization function such as a channel map.

While an embodiment in which the storage unit 140 is provided separately from the controller 170 is illustrated in FIG. 2, embodiments of the present invention are not limited thereto. The storage unit 140 may be included in the controller 170.

The user input interface unit 150 may transmit a signal input by a user to the controller 170 or transmit a signal from the controller 170 to the user.

For example, the user input interface unit 150 may transmit/receive user input signals such as power on/off, channel selection, and screen window setting to/from the remote control device 200 or transmit user input signals input through local keys (not shown) such as a power key, a channel key, a volume key, or a setting key to the controller 170. The user input interface unit 150 may transmit user input signals input through a sensor unit (not shown) to sense gesture of the user to the controller 170 or transmit a signal from the controller 170 to the sensor unit (not shown).

The controller 170 may demultiplex the TS signal input through the tuner 110, the demodulator 120, or the external device interface unit 130 or process the demultiplexed signal to generate a signal for outputting an image or audio.

The image signal processed by the controller 170 may be input to the display 180 such that an image corresponding to the image signal may be displayed on the display. In addition, the image signal processed by the controller 170 may be input to an external output device through the external device interface unit 130.

The audio signal processed by the controller 170 may be output to the audio output unit 185 in the form of sound. In addition, the audio signal processed by the controller 170 may be input to an external output device through the external device interface unit 130.

Although not shown in FIG. 2, the controller 170 may include a demultiplexer and an image processor, which will be described with reference to FIG. 3 later.

Additionally, the controller 170 may control an overall operation of the image display apparatus 100. For example, the controller 170 may control the tuner 110 to tune to an RF broadcast corresponding to a channel selected by the user or a prestored channel.

The controller 170 may control the image display apparatus 100 according to a user command input through the user input interface unit 150 or according to an internal program.

The controller 170 may control the display 180 to display an image. Herein, the image displayed on the display 180 may be a still image, a moving image, a 2D image, or a 3D image.

The controller 170 may control the predetermined 2D object in an image displayed on the display 180 as a 3D object. For example, the object may be at least one of an accessed web page (a newspaper, a magazine, etc.), an electronic program guide (EPG), various menus, a widget, an icon, a still image, a moving image and text.

Such a 3D object may be processed to have a sense of depth different from that of the image displayed on the display 180. Desirably, the 3D object may be processed to appear to protrude from the image displayed on the display 180.

The controller 170 may recognize the location of the user based on an image captured by a capture unit (not shown). For example, the controller 170 may recognize the distance between the user and the image display apparatus 100 (i.e., a z-axis coordinate). Additionally, the controller 170 may recognize an x-axis coordinate and y-axis coordinate in the display 180, corresponding to the location of the user.

Although not shown in FIG. 2, the image display apparatus 100 may further include a channel browsing processing unit for generating a thumbnail image corresponding to a channel signal or an external input signal. The channel browsing processing unit may receive a TS signal output from the demodulator 120 or a TS signal output from the external device interface unit 130, extract an image from the received TS signal, and generate a thumbnail image. The generated thumbnail image may be TS-decoded together with a decoded image and then input to the controller 170. The controller 170 may display a thumbnail list including a plurality of thumbnail images on the display 180 using received thumbnail images.

The thumbnail list may be displayed in a brief viewing manner in which the thumbnail list is displayed in a portion of the display 180 on which an image is being displayed or in a full viewing manner in which the thumbnail list is displayed over most of the display 180. Thumbnail images in the thumbnail list may be sequentially updated.

The display 180 generates drive signals by converting an image signal, a data signal, an on-screen display (OSD) signal, and a control signal processed by the controller 170 or an image signal, a data signal, and a control signal received from the external device interface unit 130.

The display 180 may be a plasma display panel (PDP), a liquid crystal display (LCD), an organic light emitting diode (OLED) display, a flexible display, or a 3D display. For 3D image viewing, the display 180 may be divided into a supplementary display type and a single display type.

In the single display type, a 3D image may be implemented on the display 180 alone without a separate subsidiary device, e.g., glasses. Examples of the single display type may include various types such as a lenticular type and a parallax barrier type.

In the supplementary display type, 3D imagery may be implemented using a subsidiary device as a viewing device (not shown), in addition to the display 180. Examples of the supplementary display type may include various types such as a head-mounted display (HMD) type and a glasses type.

The glasses type may be divided into a passive type such as a polarized glasses type and an active type such as a shutter glasses type. The HMD type may be divided into a passive type and an active type.

The viewing device (not shown) may be 3D glasses that enable 3D image viewing. The 3D glasses (not shown) may be passive-type polarized glasses or active-type shutter glasses. The 3D glasses may also be understood as conceptually including the HMD type.

The display 180 may include a touchscreen and may function as an input device as well as an output device.

The audio output unit 185 receives an audio signal processed by the controller 170 and outputs audio.

A capture unit (not shown) captures an image of the user. The capture unit (not shown) may be implemented using one camera. However, embodiments of the present invention are not limited thereto and the capture unit (not shown) may be implemented using a plurality of cameras. The capture unit (not shown) may be buried in the upper portion of the display 180 of the image display apparatus 100 or may be separately disposed. Information about the image captured by the capture unit (not shown) may be input to the controller 170.

The controller 170 may sense user gestures based on the image captured by the capture unit (not shown), the signal sensed by the sensor unit (not shown), or a combination thereof.

The power supply 190 supplies power to overall parts of the image display apparatus 100. In particular, the power supply 190 may supply power to the controller 170, which may be implemented in the form of system-on-chip (SOC), the display 180 for displaying images, and the audio output unit 185 for outputting audio signals.

Specifically, the power supply 190 may include a converter for converting alternating current (AC) power into direct current (DC) power and a DC-DC converter for changing the level of the DC power.

The remote control device 200 transmits a user input signal to the user input interface unit 150. To this end, the remote control device 200 may use Bluetooth, RF communication, infrared (IR) communication, ultra-wideband (UWB), or ZigBee. In addition, the remote control device 200 may receive an image signal, an audio signal, or a data signal from the user input interface unit 150 and then display or audibly output the received signal.

The image display apparatus 100 may be a fixed or mobile digital broadcast receiver capable of receiving a digital broadcast.

FIG. 2 is a block diagram of the image display apparatus 100 according to an embodiment of the present invention. Some of the constituents of the image display apparatus shown in the diagram may be combined or omitted or other constituents may be added thereto, according to specifications of the image display apparatus 100 as actually implemented. That is, two or more constituents of the image display apparatus 100 may be combined into one constituent or one constituent thereof may be subdivided into two or more constituents, as needed. In addition, a function performed in each block is simply illustrative and specific operations or units of the block do not limit the scope of the present invention.

Meanwhile, the image display apparatus 100 may not include the tuner 110 and the demodulator 120 as opposed to FIG. 2. Instead, the image display apparatus 100 may receive and reproduce image content through the network interface unit 135 or the external device interface 130.

The image display apparatus 100 is an exemplary image signal processing apparatus for processing signals of images stored therein or signals of input images. Another example of the image signal processing apparatus may be the above-described set-top box, DVD player, Blu-ray player, game console, or computer except for the display 180 and the audio output unit 185 shown in FIG. 2.

Figure 3:
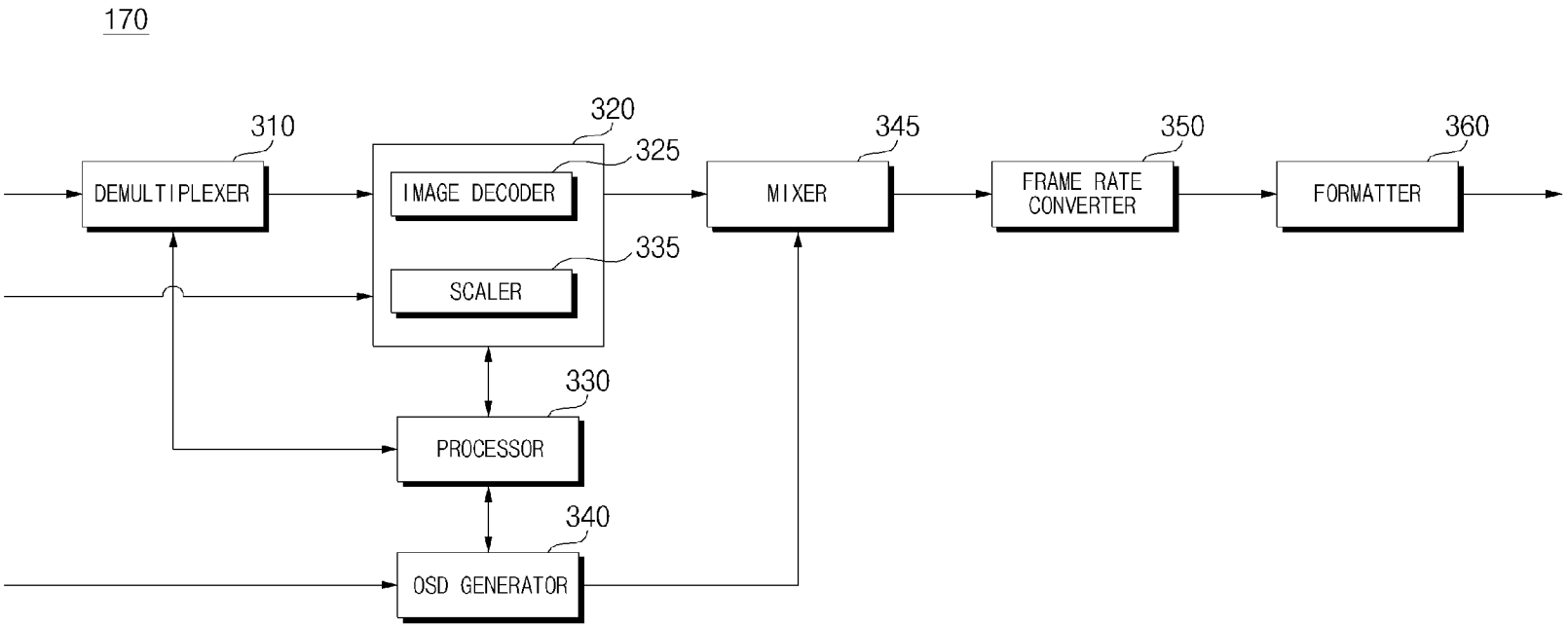
FIG. 3 is an internal block diagram of a controller of the image display apparatus of FIG. 2.

FIG. 3 is an internal block diagram of the controller shown in FIG. 2.

Referring to FIG. 3, the controller 170 according to an embodiment of the present invention may include a demultiplexer 310, an image processor 320, a processor 330, an OSD generator 340, a mixer 345, a frame rate converter 350, and a formatter 360. The controller 170 may further include an audio processor (not shown) and a data processor (not shown).

The demultiplexer 310 demultiplexes an input TS signal. For example, when an MPEG-2 TS signal is input, the demultiplexer 310 may demultiplex the MPEG-2 TS signal into an image signal, an audio signal, and a data signal. Herein, the TS signal input to the demultiplexer 310 may be a TS signal output from the tuner 110, the demodulator 120, or the external device interface unit 130.

The image processor 320 may perform image processing on the demultiplexed image signal. To this end, the image processing unit 320 may include an image decoder 325 and a scaler 335.

The image decoder 325 decodes the demultiplexed image signal and the scaler 335 scales the resolution of the decoded image signal such that the image signal can be output through the display 180.

The image decoder 325 may include various types of decoders.

The image signal decoded by the image processing unit 320 may include a 2D image signal alone, a mixture of a 2D image signal and a 3D image signal, or a 3D image signal alone.

For example, an external image signal received from an external device or a broadcast image signal of a broadcast signal received through the tuner 110 may include the 2D image signal alone, a mixture of the 2D image signal and the 3D image signal, or the 3D image signal alone. Accordingly, the controller 170, more specifically, the image processing unit 320, may perform signal processing upon the external image signal or the broadcast image signal to output the 2D image signal, a mixture of the 2D image signal and the 3D image signal, or the 3D image signal.

The image signal decoded by the image processing unit 320 may include a 3D image signal in various formats. For example, the decoded image signal may be a 3D image signal that includes a color difference image and a depth image or a 3D image signal that includes multi-viewpoint image signals. The multi-viewpoint image signals may include a left-eye image signal and a right-eye image signal, for example.

The formats of the 3D image signal may include a side-by-side format in which the left-eye image L and the right-eye image R are arranged in a horizontal direction, a top/down format in which the left-eye image and the right-eye image are arranged in a vertical direction, a frame sequential format in which the left-eye image and the right-eye image are arranged in a time division manner, an interlaced format in which the left-eye image and the right-eye image are mixed in lines, and a checker box format in which the left-eye image and the right-eye image are mixed in each box.

The processor 330 may control overall operation of the image display apparatus 100 or the controller 170. For example, the processor 330 may control the tuner 110 to tune to an RF broadcasting corresponding to a channel selected by the user or a prestored channel.

In addition, the processor 330 may control the image display apparatus 100 according to a user command input through the user input interface unit 150 or according to an internal program.

The processor 330 may control data transmission to the network interface unit 135 or the external device interface unit 130.

The processor 330 may control operations of the demultiplexer 310, image processing unit 320 and OSD generator 340 in the controller 170.

The OSD generator 340 generates an OSD signal autonomously or according to a user input signal. For example, the OSD generator 340 may generate a signal for displaying a variety of information in the form of graphics or texts on the screen of the display 180 based on a user input signal. The generated OSD signal may include a variety of data such as a user interface screen, various menu screens, a widget, and an icon of the image display apparatus 100. The generated OSD signal may also include a 2D object or a 3D object.

The OSD generator 340 may generate a pointer which can be displayed on the display, based on a pointing signal input from the remote control device 200. In particular, the pointer may be generated by a pointing signal processor (not shown) and the OSD generator 240 may include the pointing signal generator (not shown). Obviously, it is possible to provide the pointing signal processor (not shown) separately from the OSD generator 240.

The mixer 345 may mix the OSD signal generated by the OSD generator 340 with the image signal decoded by the image processing unit 320. Each of the OSD signal and the decoded image signal may include at least one of a 2D signal and a 3D signal. The mixed image signal is provided to the frame rate converter 350.

The frame rate converter (FRC) 350 may convert the frame rate of an input image. The FRC 350 may also directly output the input image without frame rate conversion.

The formatter 360 may arrange a left-eye image frame and right-eye image frame of the 3D image produced through frame rate conversion. The formatter 360 may output a synchronization signal Vsync to open a left-eye glass or right-eye glass of a 3D viewing apparatus (not shown).

The formatter 360 may receive the mixed signal, i.e., a mixture of the OSD signal and the decoded image signal, from the mixer 345 and separate the mixed signal into a 2D image signal and a 3D image signal.

The formatter 360 may change the format of the 3D image signal. For example, the formatter 360 may change the format of the 3D image signal to any of the various formats described above.

The formatter 360 may convert the 2D image signal into the 3D image signal. For example, the formatter 360 may detect an edge or a selectable object in the 2D image signal and separate and generate an object according to the detected edge or the selectable object as the 3D image signal, based on a 3D image generation algorithm. In this case, the generated 3D image signal may be separated into the left-eye image signal L and the right-eye image signal R to be aligned, as described above.

Although not shown in the figure, a 3D processor (not shown) for 3-D effect signal processing may be further disposed after the formatter 360. The 3D processor (not shown) may perform processing such as adjustment of brightness, tint, and color of an image signal to improve a 3D effect. For example, the 3D processor may perform signal processing of making parts at a close distance clear and making parts at a far distance blurry. Such functions of the 3D processor may be integrated into the formatter 360 or the image processing unit 320.

An audio processor (not shown) in the controller 170 may process the demultiplexed audio signal. To this end, the audio processor (not shown) may include various decoders.

The audio processor (not shown) in the controller 170 may perform processing such as adjustment of bass, treble, and volume.

The data processor (not shown) in the controller 170 may perform data processing on the demultiplexed data signal. For example, if the demultiplexed data signal is a coded data signal, the data processor (not shown) may decode the data signal. The coded data signal may be EPG information containing broadcast information such as a start time and end time of a broadcast program broadcast on each channel.

Although the formatter 360 performs 3D processing after the mixer 345 mixes the signals received from the OSD generator 340 and the image processing unit 320 in FIG. 3, embodiments of the present invention are not limited thereto and the mixer 345 may be disposed after the formatter 360. That is, after the formatter 360 performs 3D processing on the output of the image processing unit 320 and the OSD generator 340 generates the OSD signal and performs 3D processing, the mixer 345 may mix the 3D processed signals.

The block diagram of the controller 170 shown in FIG. 3 is simply illustrative. Constituents of the block diagram may be integrated, added or omitted according to the specifications of the controller 170 as actually implemented.

FIG. 3 is a block diagram of the controller 170 according to an embodiment of the present invention. Some of the constituents of the controller 170 may be combined or omitted or other constituents may be added thereto.

In particular, the frame rate converter 350 and the formatter 360 may not be provided in the controller 170. Instead, they may be provided individually or provided as one separate module.

Figure 4:
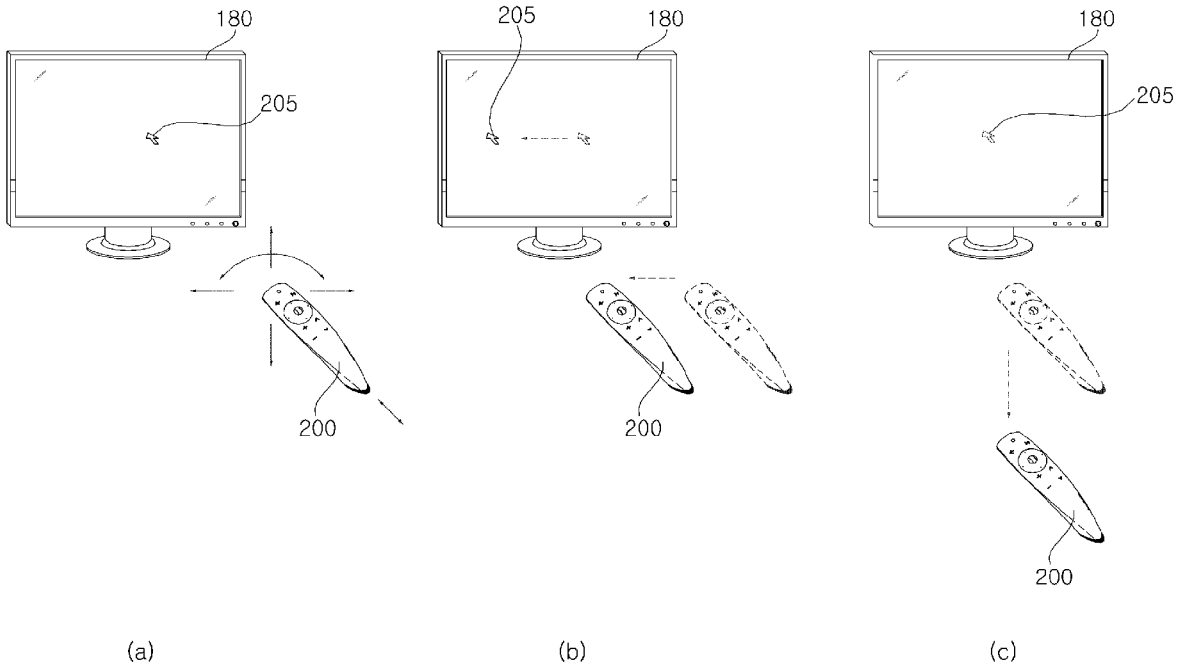
FIG. 4 is a view illustrating a method of controlling a remote control device of the image display apparatus of FIG. 2.

FIG. 4 is a view illustrating a method of controlling the remote control device shown in FIG. 2.

As shown in FIG. 4(*a*), a pointer 205 corresponding to the remote control device 200 may be displayed on the display 180.

A user may move the remote control device 200 up and down, left and right (FIG. 4(*b*)), or back and forth (FIG. 4(*c*)) or rotate the same. The pointer 205 displayed on the display 180 of the image display apparatus moves according to movement of the remote control device 200. As shown in the figure, since the pointer 205 moves according to movement of the remote control device 200 in a 3D space, the remote control device 200 may be referred to as a spatial remote control device or a 3D pointing device.

FIG. 4(*b*) illustrates a case in which the pointer 205 displayed on the display 180 moves to the left when the user moves the remote control device 200 to the left.

Information about movement of the remote control device 200 sensed through a sensor of the remote control device 200 is transmitted to the image display apparatus. The image display apparatus may calculate coordinates of the pointer 205 based on the information about the movement of the remote control device 200. The image display apparatus may display the pointer 205 such that the pointer 205 corresponds to the calculated coordinates.

FIG. 4(*c*) illustrates a case in which the user moves the remote control device 200 away from display 180 while pressing down a specific button on the remote control device 200. In this case, a selected area on the display 180 corresponding to the pointer 205 may be zoomed in and displayed with a magnified size. On the contrary, when the user moves the remote control device 200 closer to the display 180, the selected area may be zoomed out and displayed with a reduced size. Alternatively, the selected area may be zoomed out when the remote control device 200 is moved away from the display 180 and may be zoomed in when the remote control device 200 is moved closer to the display 180.

Up-and-down and left-and-right movements of the remote control device 200 may not be recognized while the specific button on the remote control device 200 is pressed down. That is, when the remote control device 200 moves away from the display 180 or approaches the display 180, the up-and-down and left-and-right movements of the remote control device 200 may not be recognized and only a back-and-forth movement of the remote control device 200 may be recognized. If the specific button on the remote control device 200 is not pressed down, only the pointer 205 moves according to the up-and-down and left-and-right movements of the remote control device 200.

The speed and direction of movement of the pointer 205 may correspond to the speed and direction of movement of the remote control device 200.

Figure 5:
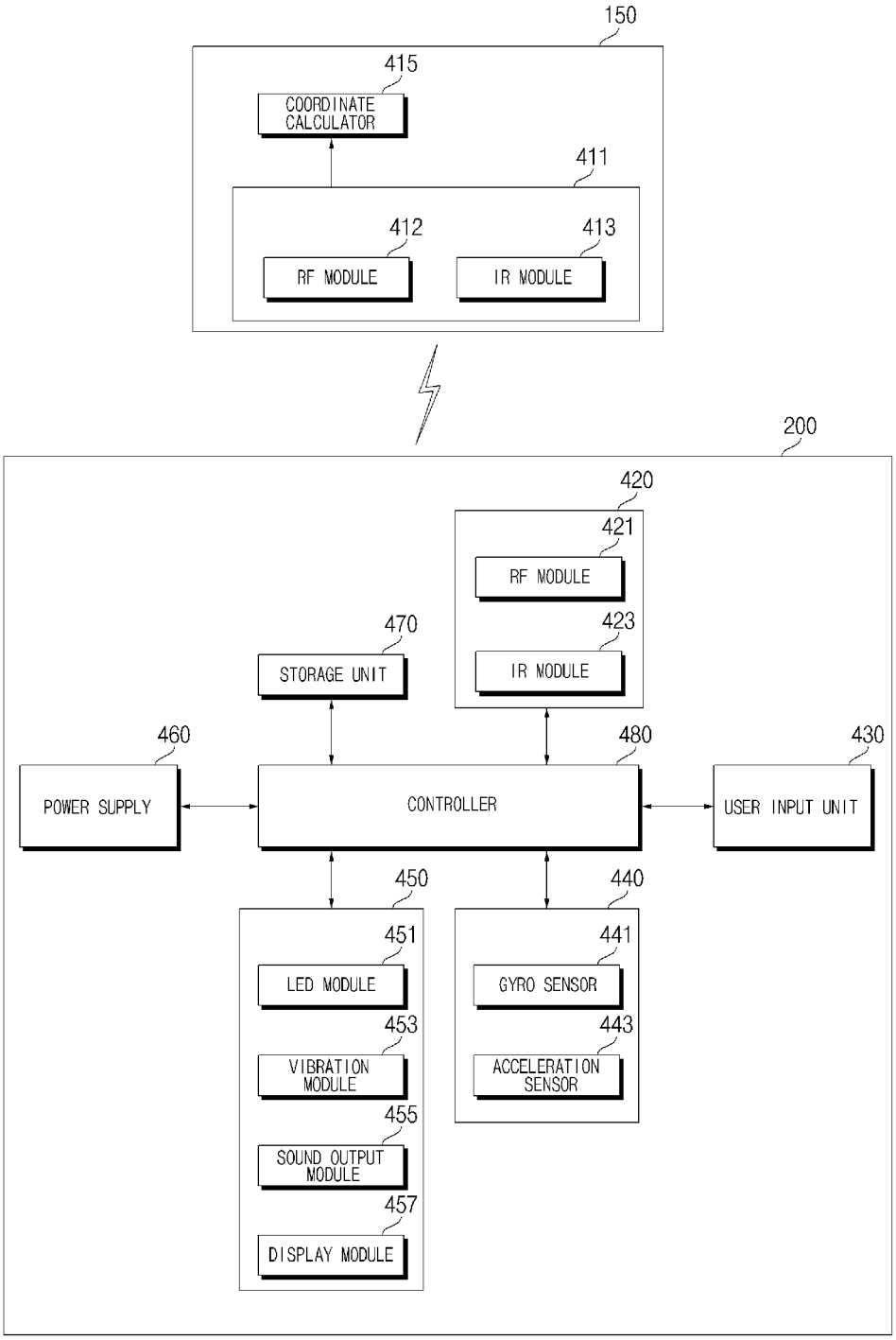
FIG. 5 is an internal block diagram of the remote control device of the image display apparatus of FIG. 2.

FIG. 5 is an internal block diagram of the remote control device shown in FIG. 2.

Referring to FIG. 5, the remote control device 200 may include a wireless communication unit 420, a user input unit 430, a sensor unit 440, an output unit 450, a power supply 460, a storage unit 470, and a controller 480.

The wireless communication unit 420 transmits and receives signals to and from one of the image display apparatuses according to embodiments of the present invention described above. Hereinafter, one image display apparatus 100 among the image display apparatuses according to embodiments of the present invention will be described by way of example.

In this embodiment, the wireless communication unit 420 may include an RF module 421 capable of transmitting and receiving signals to and from the image display apparatus 100 according to an RF communication standard. The wireless communication unit 420 may further include an IR module 423 capable of transmitting and receiving signals to and from the image display apparatus 100 according to an IR communication standard.

In this embodiment, the remote control device 200 transmits a signal containing information about movement of the remote control device 200 to the image display apparatus 100 via the RF module 421.

In addition, the remote control device 200 may receive a signal from the image display apparatus 100 via the RF module 421. As needed, the remote control device 200 may transmit commands related to power on/off, channel change, and volume change to the image display apparatus 100 via the IR module 423.

The user input unit 430 may include a keypad, buttons, a touchpad, or a touchscreen. The user may input a command related to the display apparatus 100 to the remote control device 200 by manipulating the user input unit 430. If the user input unit 430 includes a hard key button, the user may input a command related to the image display apparatus 100 to the remote control device 200 by pressing the hard key button. If the user input unit 430 includes a touchscreen, the user may input a command related to the image display apparatus 100 to the remote control device 200 by touching a soft key on the touchscreen. The user input unit 430 may include various types of input means such as a scroll key and a jog key which can be manipulated by the user and this embodiment does not limit the scope of the present invention.

The sensor unit 440 may include a gyro sensor 441 or an acceleration sensor 443. The gyro sensor 441 may sense information about movement of the remote control device 200.

For example, the gyro sensor 441 may sense information about movement of the remote control device 200 with respect to the X, Y and Z axes. The acceleration sensor 443 may sense information about the movement speed of the remote control device 200. The sensor unit 440 may further include a distance measurement sensor to sense a distance to the display 180.

The output unit 450 may output an image signal or audio signal corresponding to manipulation of the user input unit 430 or the signal transmitted by the image display apparatus 100. The user may recognize, via the output unit 450, whether the user input unit 430 is manipulated or the image display apparatus 100 is controlled.

For example, the output unit 450 may include an LED module 451 to be turned on, a vibration module 453 to generate vibration, a sound output module 455 to output sound, or a display module 457 to output an image, when the user input unit 435 is manipulated or signals are transmitted to and received from the image display apparatus 100 via the wireless communication unit 425.

The power supply 460 supplies power to the remote control device 200. If the remote control device 200 does not move for a predetermined time, the power supply 460 may stop supplying power to reduce waste of power. The power supply 460 may resume supply of power when a predetermined key provided to the remote control device 200 is manipulated.

The storage unit 470 may store various types of programs and application data necessary for control or operation of the remote control device 200. When the remote control device 200 wirelessly transmits and receives signals to and from the image display apparatus 100 via the RF module 421, the remote control device 200 and the image display apparatus 100 may transmit and receive signals in a predetermined frequency band. The controller 480 of the remote control device 200 may store, in the storage unit 470, information about a frequency band enabling wireless transmission and reception of signals to and from the image display apparatus 100 which is paired with the remote control device 200, and reference the information.

The controller 480 controls overall operation related to control of the remote control device 200. The controller 480 may transmit a signal corresponding to manipulation of a predetermined key in the user input unit 430 or a signal corresponding to movement of the remote control device 200 sensed by the sensor unit 440 to the image display apparatus 100 via the wireless communication unit 420.

The user input interface unit 150 of the image display apparatus 100 may include a wireless communication unit 411 capable of wirelessly transmitting and receiving signals to and from the remote control device 200 and a coordinate calculator 415 capable of calculating coordinates of a pointer corresponding to operation of the remote control device 200.

The user input interface unit 150 may wirelessly transmit and receive signals to and from the remote control device 200 via an RF module 412. In addition, the user input interface unit 150 may receive, via an IR module 413, a signal transmitted from the remote control device 200 according to an IR communication standard.

The coordinate calculator 415 may calculate a coordinate value (x, y) of the pointer 205 to be displayed on the display 180 by correcting hand shaking or errors in a signal corresponding to operation of the remote control device 200, which is received via the wireless communication unit 411.

The signal which is transmitted by the remote control device 200 and input to the image display apparatus 100 via the user input interface unit 150 is transmitted to the controller 170 of the image display apparatus 100. The controller 170 may determine information about an operation of the remote control device 200 or manipulation of a key from the signal transmitted by the remote control device 200 and control the image display apparatus 100 based on the information.

As another example, the remote control device 200 may calculate a coordinate value of a pointer corresponding to movement thereof and output the coordinate value to the user input interface unit 150 of the image display apparatus 100. In this case, the user input interface unit 150 of the image display apparatus 100 may transmit, to the controller 170, information about the received coordinate value of the pointer without separately correcting hand tremor or errors.

As another example, the coordinate calculator 415 may be provided in the controller 170 rather than in the user input interface unit 150 as opposed to FIG. 5.

Figure 6:
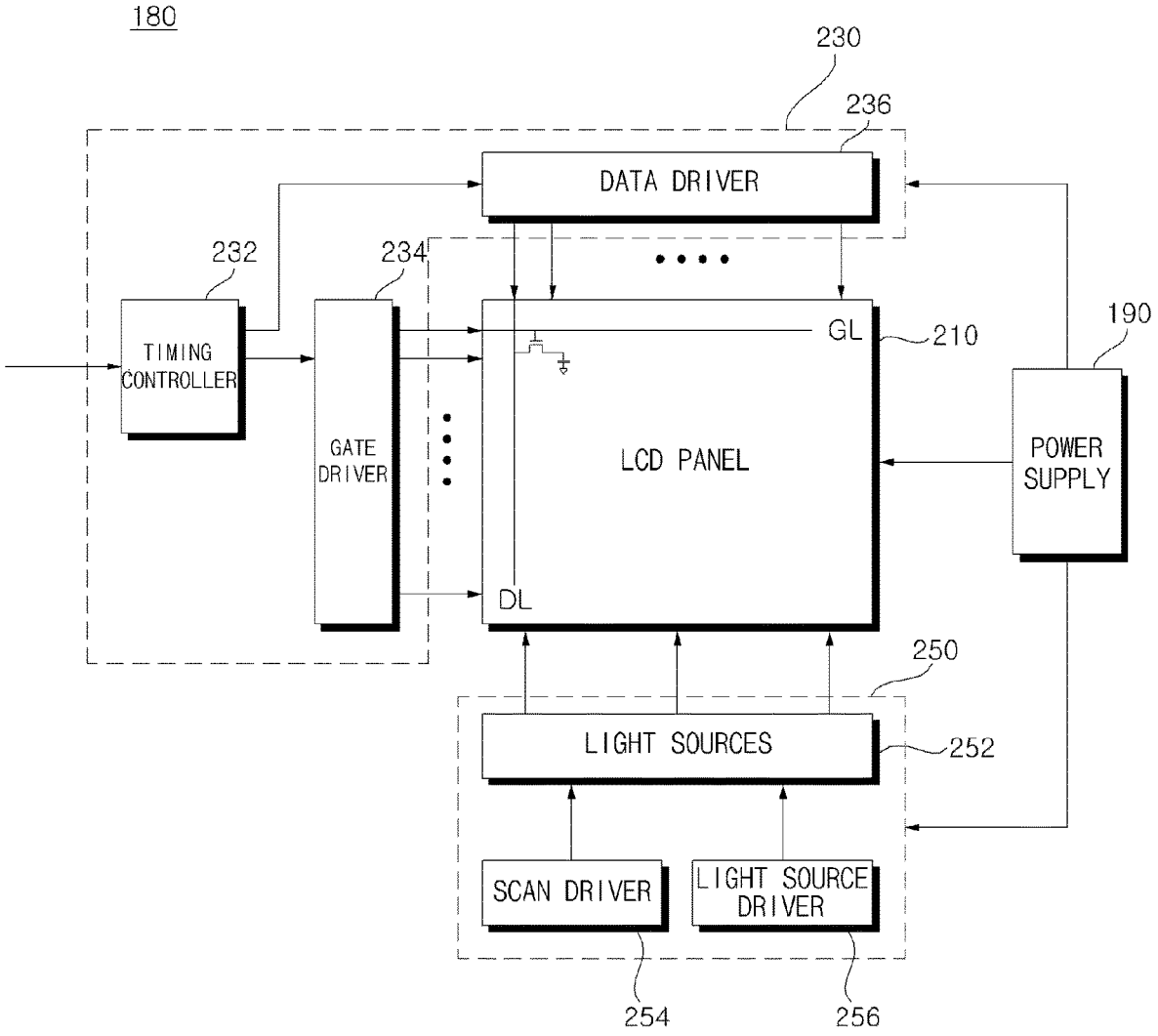
FIG. 6 is a diagram of a power supply and an internal construction of a display shown in FIG. 2.

FIG. 6 is a diagram of the power supply and an internal construction of the display shown in FIG. 2.

Referring to FIG. 6, the LCD panel based display 180 may include an LCD panel 210, a driving circuit unit 230, and a backlight unit 250.

To display images, the LCD panel 210 includes a first substrate on which a plurality of gate lines GL and a plurality of data lines DL intersect in a matrix form and thin film transistors (TFTs) and pixel electrodes connected to the TFTs are formed at the intersections, a second substrate including common electrodes, and a liquid crystal layer formed between the first substrate and the second substrate.

The driving circuit unit 230 drives the LCD panel 210 through a control signal and a data signal supplied by the controller 170 shown in FIG. 2. To this end, the driving circuit unit 230 includes a timing controller 232, a gate driver 234, and a data driver 236.

The timing controller 232 receives a control signal, an RGB data signal, and a vertical synchronization signal Vsync from the controller 170, controls the gate driver 234 and the data driver 236 based on the control signal, re-arranges the RGB data signal, and provides the re-arranged RGB data signal to the data driver 236.

The gate driver 234 and the data driver 236 provide a scan signal and a video signal to the LCD panel 210 through the gate lines GL and the data lines DL under the control of the timing controller 232.

The backlight unit 250 supplies light to the LCD panel 210. To this end, the backlight unit 250 may include a plurality of light sources 252, a scan driver 254 for controlling scanning driving of the light sources 252, and a light source driver 256 for turning on or off the light sources 252.

A predetermined image is displayed by light emitted from the backlight unit 250 in a state in which light transmittance of the liquid crystal layer is controlled by an electrical field between the pixel electrodes and the common electrodes of the LCD panel 210.

The power supply 190 may supply a common electrode voltage Vcom to the LCD panel 210 and a gamma voltage to the data driver 236. In addition, the power supply 190 supplies a driving voltage for driving the light sources 252 to the backlight unit 250.

FIG. 7 is a diagram illustrating exemplary arrangement of the light sources shown in FIG. 6.

Referring to FIG. 7, a plurality of light sources categorized as light source strings 252-1 to 252-6 may be disposed on the rear surface of the LCD panel 210.

FIG. 7 illustrates 6 light source strings 252-1 to 252-6 disposed in a bar type.

Each of the light source strings 252-1 to 252-6 may include a plurality of LEDs and light is radiated onto the front surface of the LCD panel by means of a diffusion plate that diffuses light, a reflection plate that reflects light, or an optical sheet that polarizes, scatters, and diffuses light.

Meanwhile, each of the light source strings 252-1 to 252-6 may include a plurality of LEDs that are connected in series to each other. Thus, the same current may flow into each string.

FIG. 8 is a partial circuit diagram of the image display apparatus according to an embodiment of the present invention.

Referring to FIG. 8, the image display apparatus 100 may include a plurality of light sources LS1 to LS6 1140 connected in parallel to each other, the power supply 190 for supplying a common power voltage VLED to the light sources LS1 to LS6 1140, the light source driver 256 for driving the light sources LS1 to LS6 1140, and a driving controller 1120 for controlling the light source driver 256.

Herein, the light sources LS1 to LS6 indicate string light sources and each of the string light sources may include a plurality of LEDs connected in series.

As described above, as resolution of the image display apparatus 100 increases up to HD, full HD, UHD, 4K, or 8K, the number of LEDs may increase.

Meanwhile, when the panel 210 is a high resolution panel, it is desirable to allow currents If of variable levels to flow into the light source strings 252-1 to 252-6 among the light sources 252 based on local dimming data in order to improve contrast.

According to this, the currents If of variable levels flow in proportion to the local dimming data so that each of the light source strings 252-1 to 252-6 outputs light of different luminance according to the local dimming data.

Then, luminance of a bright part becomes brighter and luminance of a dart part becomes darker due to the current If of an increased level. As a result, contrast is improved in displaying images.

The power supply 190 outputs the common voltage VLED to the light sources. To this end, the power supply 190 may include a DC/DC converter 1110 for converting the level of a DC power, an inductor L for eliminating harmonics, and a capacitor C for storing the DC power.

A voltage across both ends of the capacitor C may correspond to a voltage supplied between a node A and a ground terminal and correspond to a voltage applied to the light sources LS1 to LS6 1140, a plurality of switching elements Sa1 to Sa6, and resistor elements R1 to R6. That is, the voltage of the node A is a common voltage supplied to the light sources LS1 to LS6 and may be referred to as a VLED voltage as shown.

The VLED voltage is equal to the sum of a driving voltage Vf1 of the first light source string LS1, a voltage of both ends of the first switching element Sa, and a voltage consumed in the first resistor element Ra.

Alternatively, the VLED voltage is equal to the sum of a driving voltage Vf2 of the second light source string LS2, a voltage of both ends of the second switching element Sa2, and a voltage consumed in the second resistor element Rb. Alternatively, the VLED voltage is equal to the sum of a driving voltage Vf6 of the sixth light source string LS6, a voltage of both ends of the sixth switching element Sa6, and a voltage consumed in the sixth resistor element R6.

Meanwhile, as resolution of the panel 210 increases, the light source driving voltages Vf1 to Vf6 increase and driving currents If1 to If6 flowing into the light sources also increase. Accordingly, power consumed by the switching elements Sa1 to Sa6 and the resistor elements R1 to R6 increases and thus stress of the switching elements Sa1 to Sa6 and the resistor R1 to R6 also increases.

To reduce power consumption while the light sources are driven, it is desirable to reduce the driving currents If1 to If6 flowing into the switching elements Sa1 to Sa6 and the resistor elements R1 to R6. In this case, it is assumed that the light source driving voltages Vf1 to Vf6 are constant.

To this end, the driving controller 1120 includes a first voltage detector 1132 for detecting a voltage $V_D$ of a drain terminal D of each of the switching elements Sa1 to Sa6 configured by FETs. The driving controller 1120 may further include a second voltage detector 1134 for detecting a voltage $V_G$ of a gate terminal G of each of the switching elements Sa1 to Sa6 and a third voltage detector 1136 for detecting a voltage $V_S$ of a source terminal S of each of the switching elements Sa1 to Sa6.

The driving controller 1120 may compare drain terminal voltages $V_D$ of the respective drain terminals of the switching elements Sa1 to Sa6 with each other, generate target driving currents flowing into the light sources 1140 based on a minimum drain terminal voltage among the drain terminal voltages, and generate switching control signals SG corresponding to the generated target driving currents.

Each switching control signal SG is input to a comparator. If the level of the switching control signal SG is greater than the voltage $V_S$ of the source terminal, the switching control signal SG is output from the comparator and input to the gate terminal G. Consequently, the switching element is driven based on the switching control signal SG.

To generate the switching control signal, the driving controller 1120 may include a processor 1130 that generates the switching control signal for driving the gate terminal of each of the switching elements Sa1 to Sa6 based on the voltage of the drain terminal of each of the switching elements Sa1 to Sa6.

The processor 1130 may vary the level of the switching control signal SG based on the magnitude of the voltage $V_D$ of the drain terminal of each of the switching elements Sa1 to Sa6.

Meanwhile, the processor 1130 may vary the level of the switching control signal SG or the duty of the switching control signal SG based on the magnitude of the voltage $V_D$ of the drain terminal of each of the switching elements Sa1 to Sa6.

To improve contrast in displaying images, the processor 1130 may perform control to allow the current If having a variable level to flow into each of the light source strings 252-1 to 252-6 among the light sources 252, based on the local dimming data.

If the level of the local dimming data is equal to or higher than a first reference level Lth, this corresponds to a first mode and the processor 1130 may perform control to allow the current If having a variable level to flow into each of the light source strings 252-1 to 252-6 among the light sources 252, based on the local dimming data.

If the level of the local dimming data is lower than the first reference level Lth, this corresponds to a second mode and the processor 1130 may perform control to allow the current If having a constant level and a variable pulse width to flow into each of the light source strings 252-1 to 252-6 among the light sources, based on the local dimming data.

If the level of first local dimming data corresponding to a first region in the panel 210 is equal to or higher than the first reference level Lth and is the highest in a frame, the processor 1130 may perform control to allow a first current If having the highest level to flow into the light source strings 252-1 to 252-6 of a location corresponding to the first region.

If the level of second local dimming data corresponding to a second region in the panel 210 is the lowest in the frame, the processor 1130 may perform control to allow a second current If of the lowest level to flow into the light source strings 252-1 to 252-6 of a location corresponding to the second region.

If the level of the second local dimming data is equal to or lower than a second reference level Lth1, the processor 1130 may perform control to allow the current If having an increased level and a decreased duty to flow into the light source strings 252-1 to 252-6 of the location corresponding to the second region.

The processor 1130 may perform control to allow the current If having a sequentially variable level to flow into the light source strings 252-1 to 252-6 among the light sources 252, based on the local dimming data.

The processor 1130 may set a potential difference Vds between the drain terminal and source terminal of each of the switching elements Sa1 to Sa6 in the first mode to be smaller than that in the second mode.

As the level of the local dimming data increases, the processor 1130 may set a difference between the potential difference Vds between the drain terminal and the source terminal of each of the switching elements Sa1 to Sa6 in the second mode and that in the first mode to increase.

The processor 1130 may set the pulse width of the current If flowing into each of the light source strings 252-1 to 252-6 in the first mode to be equal to or greater than that in the second mode.

As the level of the local dimming data increases, the processor 1130 may set the level of the current If flowing into each of the light source strings 252-1 to 252-6 in the first mode to increase and, as the level of the local dimming data decreases, the processor 1130 may set the level of the current If flowing into each of the light source strings 252-1 to 252-6 in the first mode to decrease.

As the level of the local dimming data decreases, the processor 1130 may set the pulse width of the current If flowing into each of the light source strings 252-1 to 252-6 in the first mode to increase.

The processor 1130 may perform control to allow the level of the common voltage output from the power supply to be constant in each frame.

Figure 9:
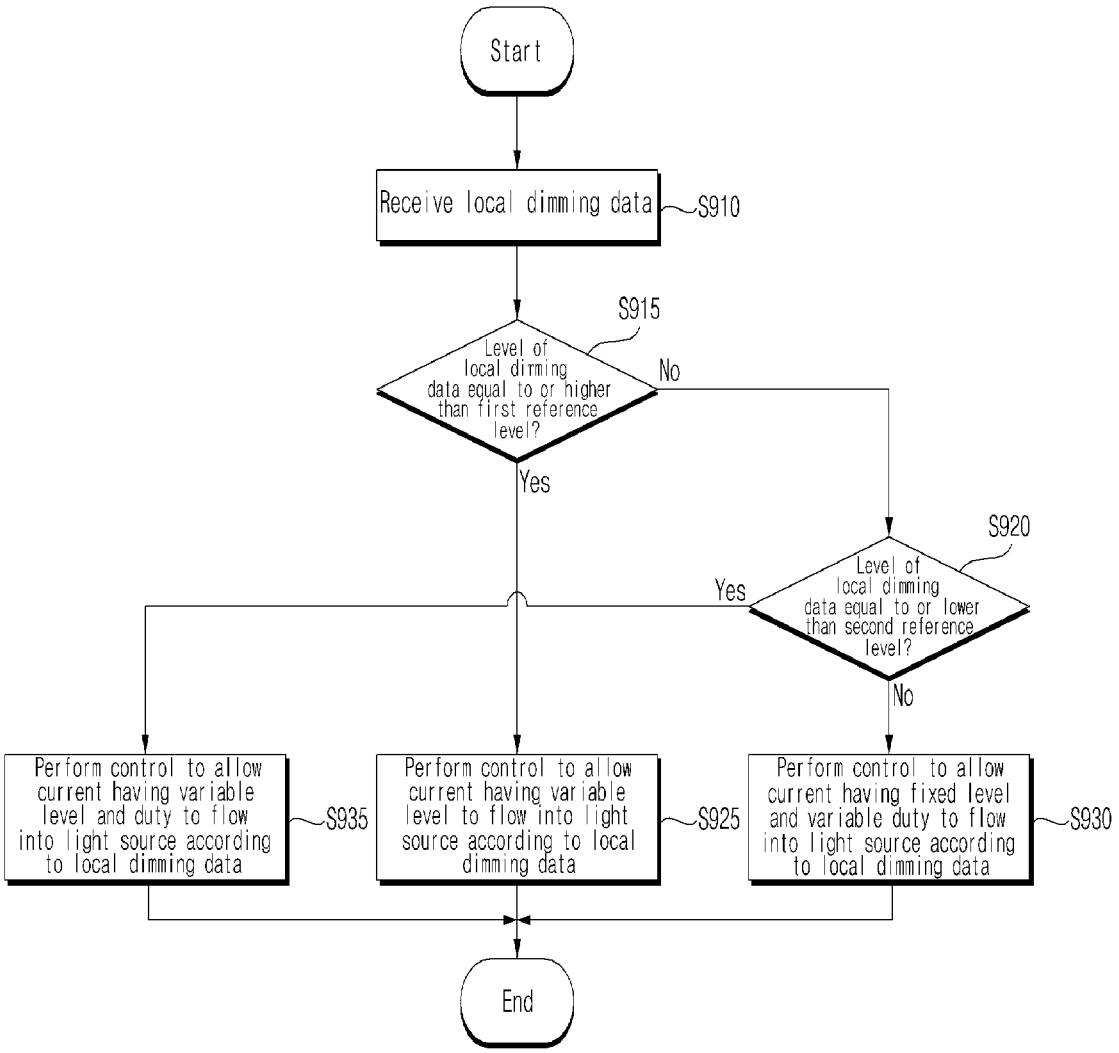
FIG. 9 is a flowchart illustrating an operation of the image display apparatus according to an embodiment of the present invention.

FIG. 9 is a flowchart illustrating an operation of the image display apparatus according to an embodiment of the present invention and FIG. 10A to FIG. 11B are diagrams referred to in explaining the operation of FIG. 9.

Referring to FIG. 9, the processor 1130 in the driving controller 1120 may receive local dimming data from the controller 170 or the driving circuit unit 230 (S910).

The local dimming data may correspond to luminance data in each region in the panel 210. As luminance increases, the level of the local dimming data may increase and, as luminance decreases, the level of the local dimming data may decrease.

The local dimming data may be received from the controller 170 or the driving circuit unit 230 on a frame basis.

Alternatively, the local dimming data may be received from the controller 170 or the driving circuit unit 230 on a multi-frame basis.

The processor 1130 in the driving controller 1120 determines whether the level of the received local dimming data is equal to or higher than a first reference level Lth (S915) and, if so, the processor 130 controls a current having a variable level to flow into a light source as a first mode according to the local dimming data (S925).

In the present invention, if the level of the local dimming data is equal to or higher than the first reference level Lth, the processor 130 may determine that this is a luminance increase mode of a minimum portion and perform control to allow a current having a variable level to flow into the light source according to the local dimming data as the first mode.

For example, if the level of the local dimming data is equal to or higher than the first reference level Lth, the processor 1130 in the driving controller 1120 may perform control to allow a current having a level proportional to the level of the local dimming data to flow into the light source.

That is, as the level of the local dimming data increases, the level of the current flowing into the light source may increase. Thus, luminance of light emitted by the light source increases due to the current having a variable level, thereby improving contrast in displaying images.

Next, if the level of the received local dimming data is lower than the first reference level Lth in step S915, the processor 1130 in the driving controller 1121 determines whether the level of the received local dimming data is equal to or lower than a second reference level Lth1 (S920).

If the level of the local dimming data exceeds the second reference level Lth1, the processor 1130 of the driving controller 1120 controls a current having a fixed level and a variable duty to flow into the light source according to the local dimming data as a second mode (S930).

Since this mode is not the luminance increase mode of a minimum portion, the processor 1130 in the driving controller 1120 may be operated in the second mode rather than a mode for increasing contrast.

That is, in the second mode, the current having a fixed level and a variable duty may flow into the light source in proportion to the level of the local dimming data. According to the second mode, power consumption can be reduced.

In step S920, if the level of the received local dimming data is equal to or lower than the second reference level Lth1, the processor 1130 in the driving controller 1120 may perform control to allow a current having a variable level and a variable duty to flow into the light source as a third mode according to the local dimming data (S935).

When the level of the received local dimming data is equal to or lower than the second reference level Lth1, if the level of the current is set to be too low, luminance emitted by the light source cannot be accurately expressed. Accordingly, if the level of the received local dimming data is equal to or lower than the second reference level Lth1, the processor 1130 in the driving controller 1120 may perform control to allow a current having the level maintained at a predetermined level or more and a reduced duty to flow into the light source.

That is, the processor 1130 may perform control to allow a current having an increased level and a decreased duty compared with the first mode to flow into the light source. Therefore, the light source can be stably driven.

Figure 10A:
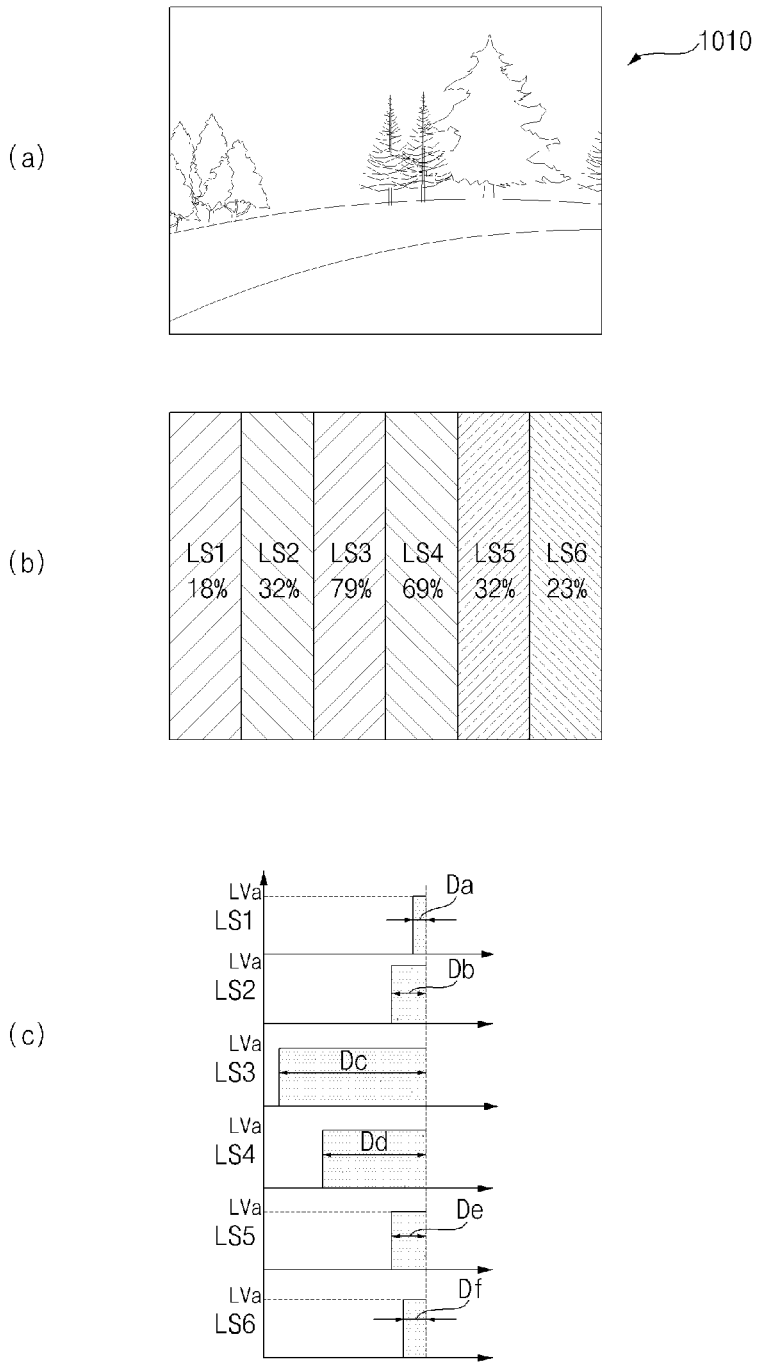
FIG. 10A to FIG. 11B are diagrams referred to in explaining the operation of FIG. 9.

FIG. 10A(a) illustrates a first image 1010 and FIG. 10A(b) illustrates local dimming data of the first image 1010 of FIG. 10A(a).

The local dimming data may be categorized according to level. However, in the figure, the local dimming data is expressed using percentage in which the highest luminance is 100% and the lowest luminance is 0%.

Meanwhile, the local dimming data may be categorized according to the light source strings LS1 to LS6.

In the figure, the levels of the local dimming data of the first to sixth light source strings LS1 to LS6 are 18%, 32%, 79%, 69%, 32%, and 23%, respectively.

Meanwhile, the above-described first reference level Lth may be about 80%.

Then, as described with reference to FIG. 9, step S930 may be performed as the second mode.

That is, the processor 1130 in the driving controller 1120 for controlling all of the switching elements Sa1 to Sa6 may perform control to allow currents having a constant level LVa and different duties as illustrated in FIG. 10A(c) to flow into the first to sixth light source strings LS1 to LS6.

FIG. 10A(c) illustrates duties Da, Db, Dc, Dd, De, and Df that are proportional to the levels of the local dimming data of the first to sixth light source strings LS1 to LS6.

To cause the currents having different duties to flow into the first to sixth light source strings LS1 to LS6, the processor 1130 may output gate driving signals having different duties to the switching elements Sa1 to Sa6.

Figure 10B:
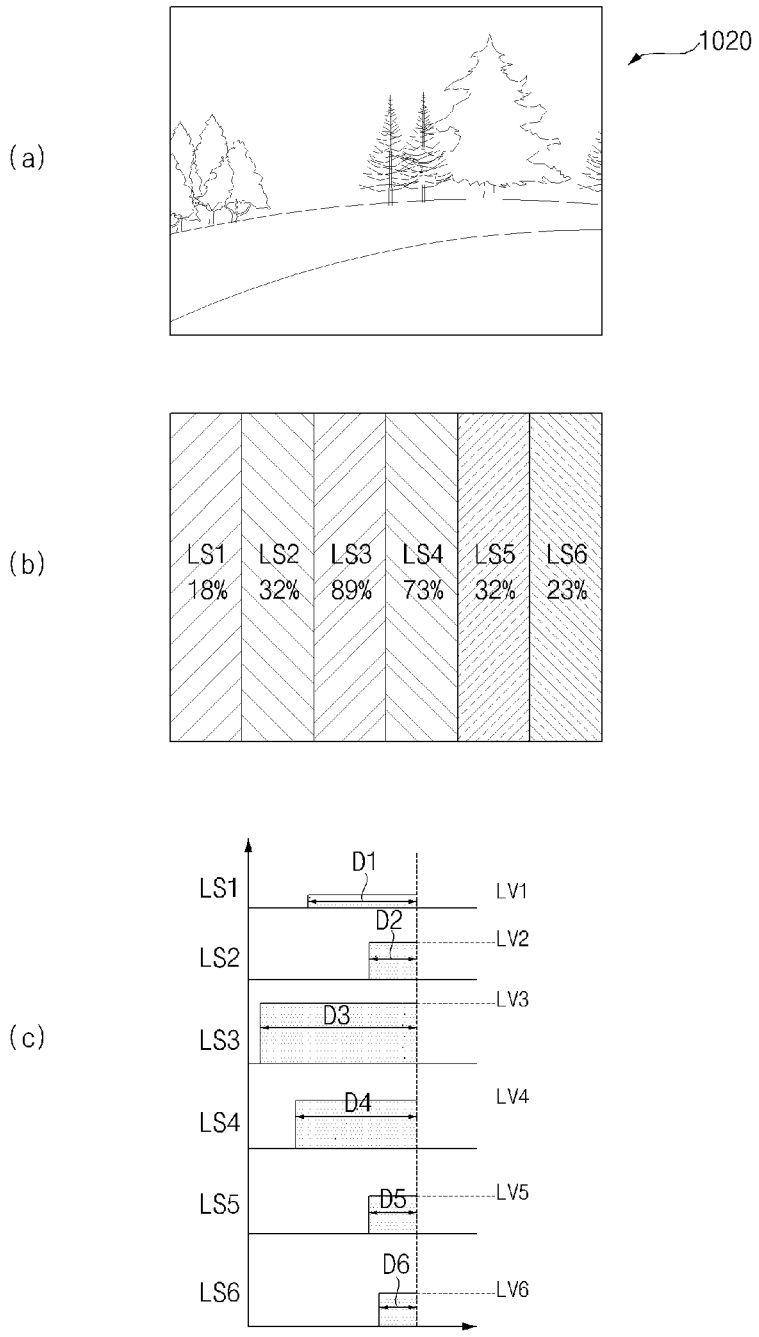

FIG. 10B(a) illustrates a second image 1020 and FIG. 10B(b) illustrates local dimming data of the second image 1020 of FIG. 10B(a).

As compared with the first image 1010 of FIG. 10A(a), the second image 1020 of FIG. 10B(a) has the third and fourth light sources LS3 and LS4 having higher levels of the local dimming data.

In FIG. 10B(b), the levels of the local dimming data of the first to sixth light source strings LS1 to LS6 are 18%, 32%, 89%, 73%, 32%, and 23%, respectively.

Meanwhile, the above-described first reference level Lth may be about 80%.

Then, as described with reference to FIG. 9, step S925 may be performed on the third light source string LS3 as the first mode.

That is, the processor 1130 in the driving controller 1120 for controlling all of the switching elements Sa1 to Sa6 may perform control to allow currents having different levels to flow into the first to sixth light source strings LS1 to LS6 according to the levels of the local dimming data of the first to sixth light source strings LS1 to LS6, as illustrated in FIG. 10B(c).

FIG. 10A(c) illustrates current levels LV1, LV2, LV3, LV4, LV5, and LV6 that are proportional to the levels of the local dimming data of the first to sixth light source strings LS1 to LS6.

As shown, the magnitude of the current levels may be LV3>LV4>LV2=LV5>LV6>LV1.

In this way, if the third light source string LS3 is in a luminance increase mode, the processor 1130 in the driving controller 1120 may perform control to allow currents having different levels to flow into the first to sixth light source strings LS1 to LS6 according to the levels of the local dimming data of the first to sixth light source strings LS1 to LS6, thereby increasing contrast.

To cause the currents having different levels to flow into the first to sixth light source strings LS1 to LS6, the processor 1130 may output gate driving signals having different levels to the switching elements Sa1 to Sa6.

Meanwhile, the processor 1130 may perform control to allow currents having different duties as well as different levels to flow into the first to sixth light source strings LS1 to LS6.

FIG. 10B(c) illustrates duties D1, D2, D3, D4, D5, and D6 considering the local dimming data of the first to sixth light source strings LS1 to LS6.

The magnitude of the duties may be D3>D4>D1>D2=D5>D6.

Figure 10C:
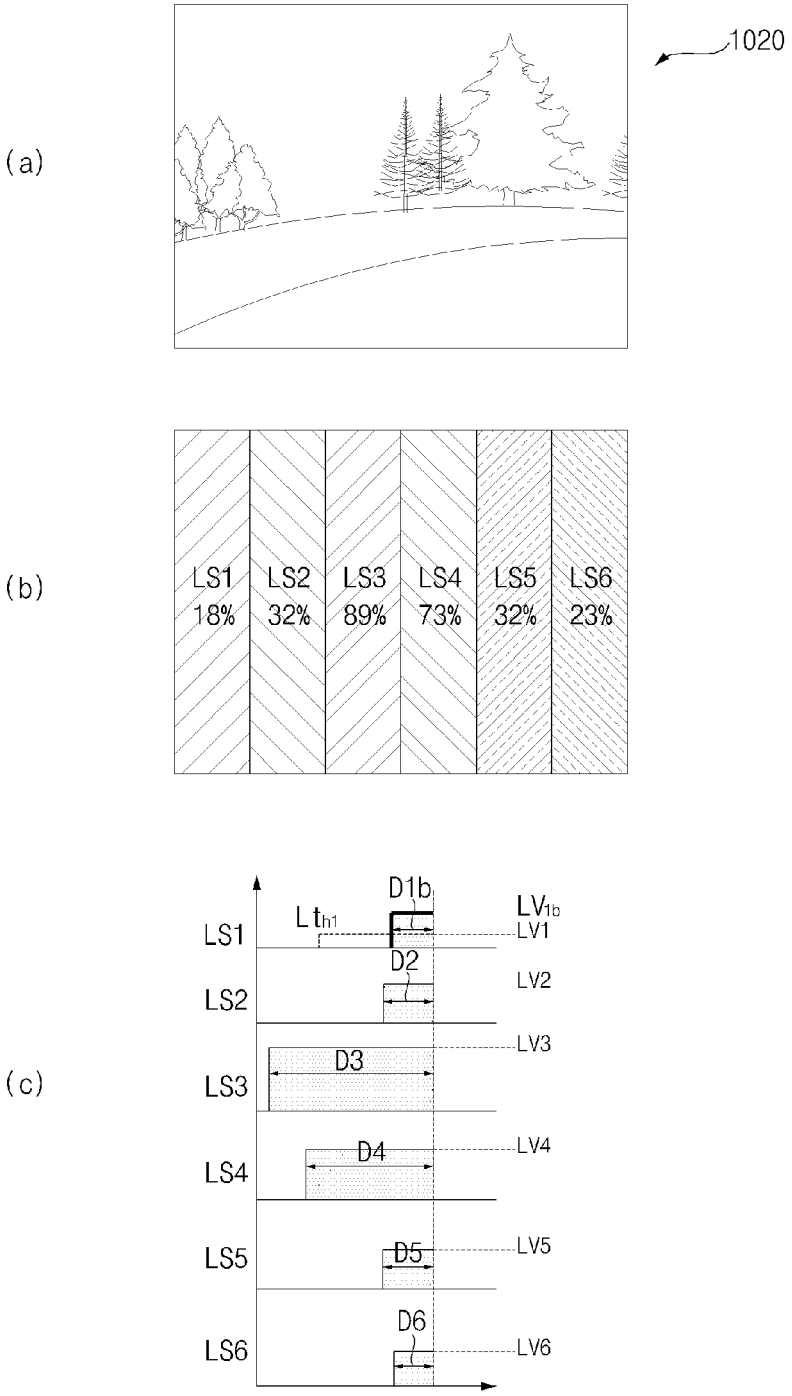

FIG. 10C illustrates the same image 1020 as that shown in FIG. 10B and the same local dimming data of the first to sixth light source strings LS1 to LS6 as that shown in FIG. 10B.

If the level of second local dimming data is equal to or lower than the second reference level Lth1, the processor 1130 perform control to allow currents If of increased levels and decreased duties to flow into the light source strings 252-1 to 252-6 of a location corresponding to a second region.

The second reference level Lth1 may be 20% or less.

Meanwhile, as illustrated in FIG. 10C(c), when the level of the local dimming data of the first light source string LS1 is equal to or lower than the second reference level Lth1, if the level of the current is set to be too low, luminance of light emitted by the light source cannot be accurately expressed. Therefore, the processor 1130 in the driving controller 1120 may perform control to allow a current having an increased level to $LV_{1b}$ and a decreased duty to D1*b* to flow into the first light source string LS1.

Thus, the first light source string LS1 can be stably driven.

The processor 1130 may perform control to allow currents If having sequentially variable levels to flow into the light source strings 252-1 to 252-6 based on the local dimming data. This will now be described with reference to FIG. 10D.

Figure 10D:
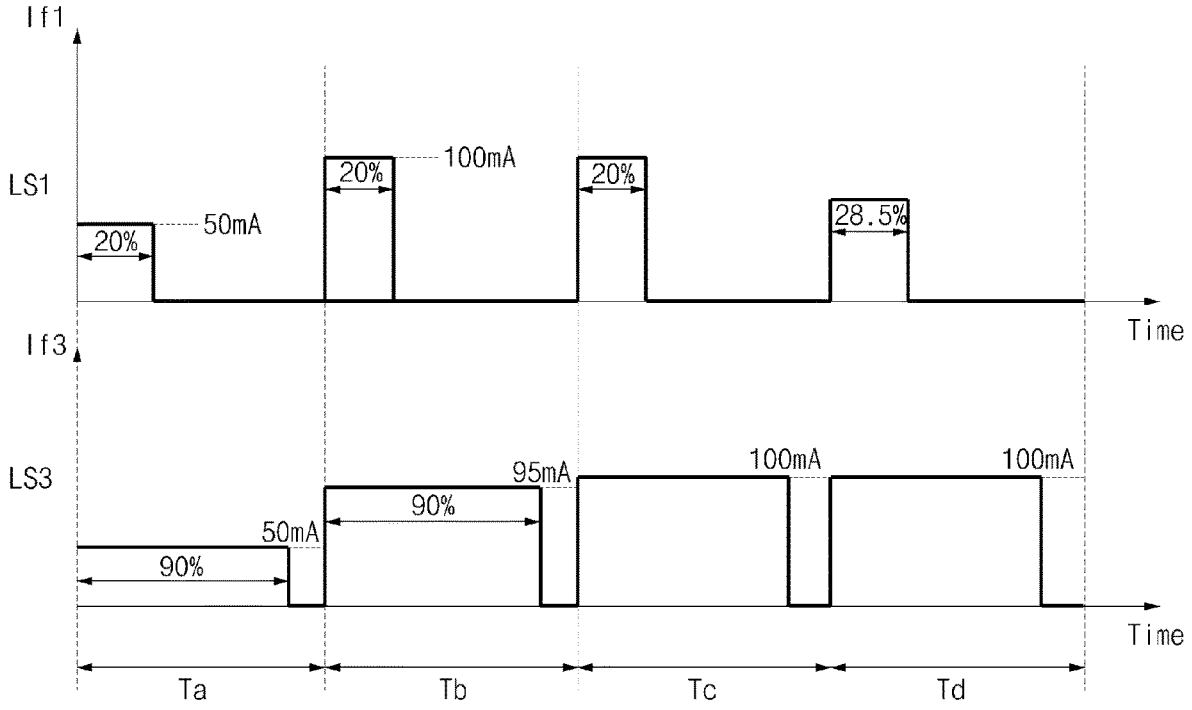

FIG. 10D illustrates currents flowing into the first light source string LS1 and the third light source string LS3.

During a time Ta, a current having a duty of 20% and a magnitude of 50 mA and a current having a duty of 90% and a magnitude of 50 mA flow into the first light source string LS1 and the third light source string LS3, respectively.

During a time Tb, a current having a duty of 20% and a magnitude of 100 mA and a current having a duty of 90% and a magnitude of 95 mA flow into the first light source string LS1 and the third light source string LS3, respectively.

During a time Tc, a current having a duty of 20% and a magnitude of 100 mA and a current having a duty of 100% and a magnitude of 100 mA flow into the first light source string LS1 and the third light source string LS3, respectively.

During a time Td, a current having a duty of 28.5% and a magnitude of 75 mA and a current having a duty of 100% and a magnitude of 100 mA flow into the first light source string LS1 and the third light source string LS3, respectively.

As illustrated in FIG. 10D, the processor 1130 may perform control to allow currents If having sequentially variable levels to flow the light source strings 252-1 to 252-6 among the light sources, based on the local dimming data. Thus, since luminance is not abruptly changed, peak noise can be reduced and power consumption can be reduced.

Figure 11A:
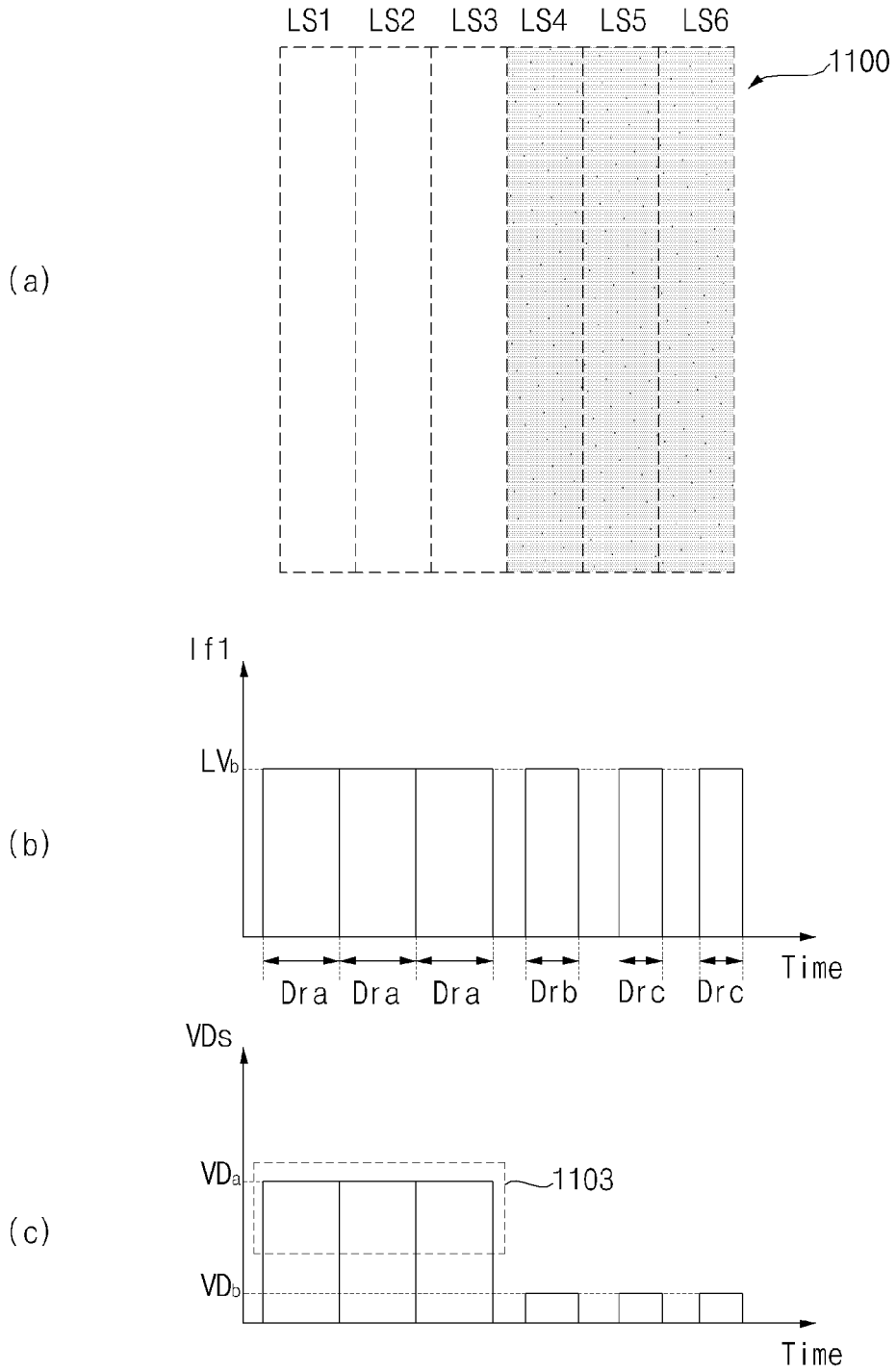
Figure 11B:
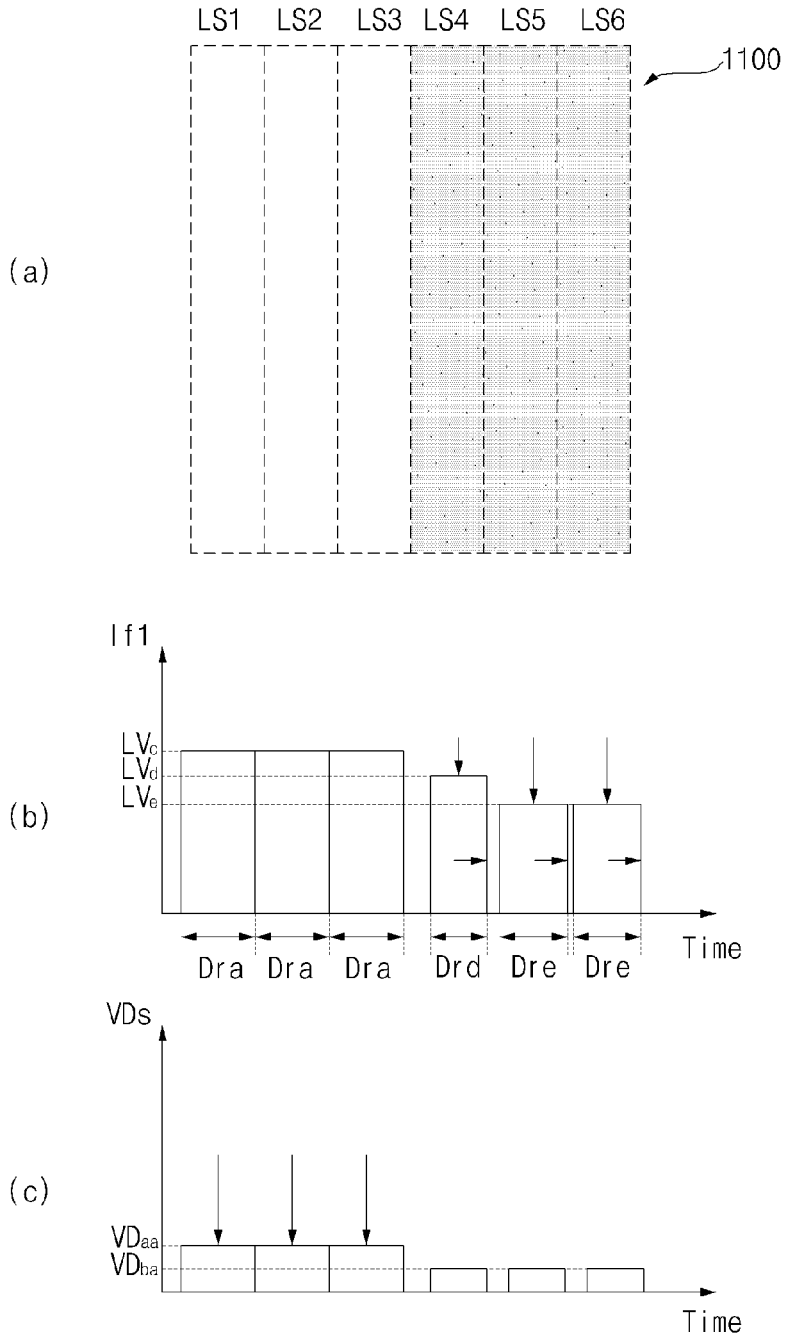

FIG. 11A and FIG. 11B illustrate another exemplary image pattern.

An image pattern 1100 illustrated in FIG. 11A and FIG. 11B has the highest luminance, i.e., luminance of 100%, in the first to third light source strings LS1 to LS3 and the lowest luminance in the fourth to sixth light source strings LS4 to LS6.

FIG. 11A(b) and FIG. 11A (c) illustrate currents flowing into the light source strings LS1 to LS6 and potential differences VDs between the gate terminals and the drain terminals of the switching elements Sa1 to Sa6, respectively, when the light source strings are driven in the second mode with respect to the image pattern 1100.

FIG. 11A(b) illustrates currents having the same level $LV_b$ flowing into the first to sixth light source strings LS1 to LS6. Duties of the currents flowing into the first to third light source strings LS1 to LS3 are Dra and duties of the currents flowing into the fourth to sixth light source strings LS4 to LS6 are Drb, Drc, and Drc, respectively.

FIG. 11A(c) illustrates the potential differences VDs between the gate terminals and the drain terminals of the switching elements Sa1 to Sa6, corresponding to the first to sixth light source strings LS1 to LS6.

Referring to FIG. 11A(b) and FIG. 11A(c), levels of the potential differences VDs between the gate terminals and the drain terminals of the switching elements Sa1 to Sa3, corresponding to the first to third light source strings LS1 to LS3 into which currents having the largest duty flow are VDa which is considerably large, thereby generating stress in the first to third switching elements Sa1 to Sa3. That is, heat is generated by the switching elements Sa1 to Sa3 and considerable power is consumed by the switching elements Sa1 to Sa3.

According to the present invention, as described above, when the level of the local dimming data is equal to or higher than the first reference level, a control operation may be performed such that currents If having variable levels flow into the light source strings 252-1 to 252-6 among the light sources 252 based on the local dimming data as illustrated in FIG. 11B.

Meanwhile, the processor 1130 may set the potential difference Vds between the drain terminal and the source terminal of each of the switching elements Sa1 to Sa6 in the first mode to be smaller than that in the second mode.

The processor 1130 may set a difference between the potential difference between the drain terminal and the source terminal of each of the switching elements Sa1 to Sa6 in the second mode and that in the first mode to increase as the level of the local dimming data increases.

The processor 1130 may set the pulse width of the current If flowing into each of the light source strings 252-1 to 252-6 in the first mode to be equal to or greater than that in the second mode.

The processor 1130 may set the level of the current If flowing into each of the light source strings 252-1 to 252-6 in the first mode to increase as the level of the local dimming data increases and set the level of the current If flowing into each of the light source strings 252-1 to 252-6 in the first mode to decrease as the level of the local dimming data decreases.

The processor 1130 may set the pulse width of the current If flowing into each of the light source strings 252-1 to 252-6 in the first mode to increase as the level of the local dimming data decreases.

This will now be described with reference to FIG. 11B.

FIG. 11B(b) and FIG. 11B(c) illustrate currents flowing into the light source strings LS1 to LS6 and potential differences VDs between the gate terminals and the drain terminals of the switching elements Sa1 to Sa6, respectively, when the light source strings are driven in the first mode with respect to the image pattern 1100.

FIG. 11B(b) illustrates currents having different levels LVc, LVc, LVc, LVd, LVe, and LVe flowing into the first to sixth light source strings LS1 to LS6. Duties of the currents flowing into the first to third light source strings LS1 to LS3 are all Dra and duties of the currents flowing into the fourth to sixth light source strings LS4 to LS6 are Drd, Dre, and Dre, respectively.

FIG. 11B(c) illustrates the potential differences VDs between the gate terminals and the drain terminals of the switching elements Sa1 to Sa6, corresponding to the first to sixth light source strings LS1 to LS6.

Referring to FIG. 11B(b) and FIG. 11B(c), levels of the potential differences VDs between the gate terminals and the drain terminals of the switching elements Sa1 to Sa3, corresponding to the first to third light source strings LS1 to LS3 into which currents having the largest duty flow are VDaa which is considerably reduced as compared with the levels VDa of the potential differences VDs in FIG. 11A(c).

Therefore, switching stress of the switching elements is considerably reduced and power consumption is also reduced.

According to an embodiment of the present invention, an image display apparatus includes a panel, a plurality of light sources to output light to the panel, a plurality of switching elements to switch the light sources, and a processor to control the switching elements, wherein the processor controls a current having a variable level to flow into each light source string among the light sources, based on local dimming data, thereby improving contrast in displaying images.

If a level of the local dimming data is equal to or higher than a first reference level, the processor controls a current having a variable level to flow into each light source string among the light sources as a first mode, based on the local dimming data, thereby improving contrast in displaying images.

As the level of the local dimming data decreases, the processor sets a level of the current flowing into each light source string in the first mode to decrease, thereby reducing heat generated by the switching elements. Therefore, circuit elements can be protected from damage.

If the level of the local dimming data is lower than the first reference level, the processor controls a current having a constant level and a variable pulse width to flow into each light source string among the light sources as a second mode, based on the local dimming data, thereby reducing power consumption.

The processor sets a potential difference between a drain terminal and a source terminal of each of the switching elements in the first mode to be smaller than a potential difference between a drain terminal and a source terminal of each of the switching elements in the second mode, thereby reducing switching loss in the first mode.

The processor sets a difference between the potential difference between the drain terminal and the source terminal of each of the switching elements in the second mode and the potential difference between the drain terminal and the source terminal of each of the switching elements in the first mode to increase as the level of the local dimming data increases, thereby further reducing switching loss in the first mode.

Meanwhile, an operation method of the image display apparatus according to the present invention may be implemented as processor-readable code that can be written in a recording medium readable by a processor included in the image display apparatus. The processor-readable recording medium includes any type of recording device in which processor-readable data is stored. Examples of the processor-readable recording medium include a ROM, a RAM, a CD-ROM, a magnetic tape, a floppy disk, an optical data storage device, and a carrier wave such as data transmission over the Internet. The processor-readable recording medium can be distributed over computer systems connected to a network so that processor-readable code is stored therein and executed therefrom in a decentralized manner.

While the present invention has been particularly shown and described with reference to exemplary embodiments thereof, it will be understood by those of ordinary skill in the art that various changes in form and detail may be made herein without departing from the spirit and scope of the present invention as defined by the following claims and such modifications and variations should not be understood individually from the technical idea or aspect of the present invention.

What is claimed is:

1. An image display apparatus, comprising:

a panel;

a plurality of light sources to output light to the panel;

a plurality of switching elements electrically connected to light source strings of the plurality of light sources that are connected in parallel to each other and to switch the light source strings, respectively; and a processor to control the switching elements, wherein the processor controls a current to flow into each of the light source strings among the plurality of light sources, based on local dimming data, wherein, if a level of first local dimming data corresponding to a first region in the panel is equal to or higher than a first reference level, the processor controls a first current having a variable level to flow into one of the light source strings for a location corresponding to the first region, and wherein the processor is further configured to:

if a level of the local dimming data is equal to or higher than the first reference level, control a current having a variable level to flow into each of the light source strings among the plurality of light sources as a first mode, based on the local dimming data, if the level of the local dimming data is lower than the first reference level, control a current having a constant level and a variable pulse width to flow into each of the light source strings among the plurality of light sources as a second mode, based on the local dimming data, and set a potential difference between a drain terminal and a source terminal of each of the switching elements in the first mode to be smaller than a potential difference between the drain terminal and the source terminal of each of the switching elements in the second mode.

2. The image display apparatus according to claim 1, wherein, if the level of second local dimming data corresponding to a second region in the panel is equal to or lower than a second reference level, the processor controls a current having a variable duty to flow into one of the light source strings for a location corresponding to the second region.

3. The image display apparatus according to claim 2, wherein, if a level of the second local dimming data corresponding to the second region in the panel is the lowest in a frame, the processor controls a second current having the lowest level to flow into one of the light source strings for the location corresponding to the second region.

4. The image display apparatus according to claim 1, wherein the processor controls a current having a variable duty to flow into each of the light strings among the plurality of light sources, based on the local dimming data.

5. The image display apparatus according to claim 1, wherein the processor controls a current having a sequentially variable level to flow into each of the light source strings among the plurality of light sources, based on the local dimming data.

6. The image display apparatus according to claim 1, wherein the processor sets a difference between a potential difference between the drain terminal and the source terminal of each of the switching elements in the second mode and the potential difference between the drain terminal and the source terminal of each of the switching elements in the first mode to increase as the level of the local dimming data increases.

7. The image display apparatus according to claim 1, wherein the processor sets a pulse width of a current flowing into each of the light source strings in the first mode to be equal to or greater than a pulse width of a current flowing into each of the light source strings in the second mode.

8. The image display apparatus according to claim 7, wherein the processor sets a level of the current flowing into each of the light source strings in the first mode to increase as the level of the local dimming data increases and sets a level of the current flowing into each of the light source strings in the first mode to decrease as the level of the local dimming data decreases.

9. The image display apparatus according to claim 8, wherein the processor sets the pulse width of the current flowing into each of the light source strings in the first mode to increase as the level of the local dimming data decreases.

10. The image display apparatus according to claim 1, further comprising:

a power supply to output a common voltage to the plurality of light sources;

a light source driver to drive the light plurality of sources using the common voltage; and a driving controller to control the light source driver, wherein the light source driver includes the switching elements to switch the lights source strings of the plurality of light sources, and wherein the driving controller includes the processor to generate a switching control signal for driving a gate terminal of each of the switching elements, based on a voltage of the drain terminal of each of the switching elements.

11. The image display apparatus according to claim 10, wherein the processor controls a level of the common voltage output from the power supply to be constant with respect to each frame.

12. The image display apparatus according to claim 10, wherein the driving controller further comprises:

a first voltage detector to detect the voltage of the drain terminal of each of the switching elements;

a second voltage detector to detect the voltage of the gate terminal of each of the switching elements; and a third voltage detector to detect a voltage of the source terminal of each of the switching elements.

13. An image display apparatus, comprising:

a panel;

a plurality of light sources to output light to the panel;

a plurality of switching elements electrically connected to light source strings of the plurality of light sources that are connected in parallel to each other and to switch the plurality of light source strings, respectively; and a processor to control the switching elements, wherein the processor controls a current to flow into each of the light source strings among the plurality of light sources, based on local dimming data, wherein, if a level of first local dimming data corresponding to a first region in the panel is equal to or higher than a first reference level, the processor controls a first current having a variable level to flow into one of the light source strings for a location corresponding to the first region, and wherein the processor sets a potential difference between a drain terminal and a source terminal of each of the switching elements, in a first mode in a case of a level of the local dimming data being equal to or higher than the first reference level, to be smaller than the potential difference between the drain terminal and the source terminal of each of the switching elements in a second mode in a case of the level of the local dimming data being lower than the first reference level.

14. The image display apparatus according to claim 13, wherein the processor sets a difference between the potential difference between the drain terminal and the source terminal of each of the switching elements in the second mode and the potential difference between the drain terminal and the source terminal of each of the switching elements in the first mode to increase as the level of the local dimming data increases.

15. The image display apparatus according to claim 13, wherein the processor sets a pulse width of a current flowing into each of the light source strings in the first mode to be equal to or greater than a pulse width of a current flowing into each of the light source strings in the second mode.

16. The image display apparatus according to claim 15, wherein the processor sets a level of the current flowing into each of the light source strings in the first mode to increase as the level of the local dimming data increases and sets a level of the current flowing into each of the light source strings in the first mode to decrease as the level of the local dimming data decreases.

17. The image display apparatus according to claim 15, wherein the processor sets the pulse width of the current flowing into each of the light source strings in the first mode to increase as the level of the local dimming data decreases.

18. The image display apparatus according to claim 13, further comprising:

a power supply to output a common voltage to the plurality of light sources;

a light source driver to drive the light plurality of sources using the common voltage; and a driving controller to control the light source driver, wherein the light source driver includes the switching elements to switch the lights source strings of the plurality of light sources, and wherein the driving controller includes the processor to generate a switching control signal for driving a gate terminal of each of the switching elements, based on a voltage of the drain terminal of each of the switching elements.

19. An image display apparatus, comprising:

a panel;

a plurality of light sources to output light to the panel;

a plurality of switching elements electrically connected to light source strings of the plurality of light sources that are connected in parallel to each other and to switch the light source strings, respectively; and a processor to control the switching elements, wherein, if a level of local dimming data is equal to or higher than a first reference level, the processor controls a current having a variable level to flow into each of the light source strings among the plurality of light sources as a first mode, based on the local dimming data, wherein, if the level of the local dimming data is lower than the first reference level, the processor controls a current having a constant level and a variable pulse width to flow into each of the light source strings among the plurality of light sources as a second mode, based on the local dimming data, wherein, if a level of first local dimming data corresponding to a first region in the panel is equal to or higher than the first reference level, the processor controls a first current having a variable level to flow into one of the light source strings for a location corresponding to the first region, and wherein the processor is configured to:

set a pulse width of a current flowing into a corresponding one of the light source strings in the first mode to be equal to or greater than a pulse width of a current flowing into each of the light source strings in the second mode, set a level of the current flowing into the corresponding one of the light source strings in the first mode to increase as the level of the local dimming data increases and set a level of the current flowing into the corresponding one of the light source strings in the first mode to decrease as the level of the local dimming data decreases, and set the pulse width of the current flowing into the corresponding one of the light source strings in the first mode to increase as the level of the local dimming data decreases.

20. The image display apparatus according to claim 19, wherein, if the level of second local dimming data corresponding to a second region in the panel is equal to or lower than a second reference level, the processor controls a current having a variable duty to flow into one of the light source strings for a location corresponding to the second region.

* * * * *